US011732321B2

(12) United States Patent
Takeda et al.

(10) Patent No.: US 11,732,321 B2
(45) Date of Patent: Aug. 22, 2023

(54) STEEL SHEET AND METHOD OF PRODUCING SAME

(71) Applicant: NIPPON STEEL CORPORATION, Tokyo (JP)

(72) Inventors: Kengo Takeda, Tokyo (JP); Hitoshi Nikaido, Tokyo (JP); Hiroyuki Kawata, Tokyo (JP); Takafumi Yokoyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/434,981

(22) PCT Filed: Mar. 12, 2020

(86) PCT No.: PCT/JP2020/010938
§ 371 (c)(1),
(2) Date: Aug. 30, 2021

(87) PCT Pub. No.: WO2020/203159
PCT Pub. Date: Oct. 8, 2020

(65) Prior Publication Data

US 2022/0145417 A1 May 12, 2022

(30) Foreign Application Priority Data

Mar. 29, 2019 (JP) ..... 2019-068535

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/007* (2013.01);
(Continued)

(58) Field of Classification Search
None
See application file for complete search history.

(56) References Cited

U.S. PATENT DOCUMENTS 9,670,569 B2 6/2017 Nozaki et al.
10,167,539 B2 1/2019 Sano et al.
(Continued)

FOREIGN PATENT DOCUMENTS

IN 2898/CHENP/2010 11/2010
IN 1890/DELNP/2013 10/2014
(Continued)

OTHER PUBLICATIONS

Bib Data and Translation—JP-5217395-B2; Matsuda H; Jun. 2013 (Year: 2013).*
(Continued)

*Primary Examiner* — Humera N. Sheikh
*Assistant Examiner* — Elizabeth D Ivey
(74) *Attorney, Agent, or Firm* — Birch, Stewart, Kolasch & Birch, LLP

(57) ABSTRACT

Provided are: a steel sheet having a high strength and excellent stretch formability; and a method of producing the same. The steel sheet has prescribed chemical composition and structure, in which the integration degree of the (111) <112> orientation of ferrite is 3.0 or higher, and the integration degree of the (252)<2-11> orientation of martensite and tempered martensite is 5.0 or lower. The method of producing the steel sheet includes: the step of continuously casting a molten steel having the prescribed chemical composition, and performing 5 to 40% rolling reduction at a temperature of 800° C. to lower than 1,200° C. in a period after the continuous casting until cooling to room temperature; the hot rolling step of performing hot rolling with a finishing temperature of 650 to 950° C.; the step of coiling
(Continued)

the resulting hot-rolled steel sheet at a coiling temperature of 400 to 700° C.; the step of retaining the hot-rolled steel sheet at (coiling start temperature+20° C. to 100° C.) for 5 to 300 minutes; the step of cold rolling the hot-rolled steel sheet at a rolling reduction ratio of 10.0 to 90.0%; and the step of annealing the resulting cold-rolled steel sheet at 700 to 900° C.

4 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |

(52) U.S. Cl.

CPC ..... *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/10* (2013.01); *C22C 38/44* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2017/0096723 | A1 | 4/2017 | Kasuya et al. |
| 2018/0002799 | A1 | 1/2018 | Futamura et al. |
| 2018/0010226 | A1 | 1/2018 | Ikeda et al. |

FOREIGN PATENT DOCUMENTS

| | | | | |
|---|---|---|---|---|
| IN | 10051/DELNP/2013 | | | 1/2015 |
| JP | 2000-297349 | A | | 10/2000 |
| JP | 2004100027 | A | * | 4/2004 |
| JP | 2009-132981 | A | | 6/2009 |
| JP | 2009132981 | A | * | 6/2009 |
| JP | 2010-236027 | A | | 10/2010 |
| JP | 2011-32543 | A | | 2/2011 |
| JP | 5217395 | B2 | * | 6/2013 |
| JP | 2015-86403 | A | | 5/2015 |
| JP | 2015-193897 | A | | 11/2015 |
| JP | 2016-130355 | A | | 7/2016 |
| JP | 2016-130357 | A | | 7/2016 |
| JP | 2017-145469 | A | | 8/2017 |
| JP | 2017145469 | A | * | 8/2017 |

OTHER PUBLICATIONS

Bib Data and translation; JP-2009132981-A; Matsuda H; Jun. 2009 (Year: 2009).*

Bib Data and translation;JP-2004100027-A; Hasegawa H;Apr. 2004 (Year: 2004).*

Bib Data and translation; JP-2017145469-A; Fujiwara T; Aug. 2017 (Year: 2017).*

* cited by examiner

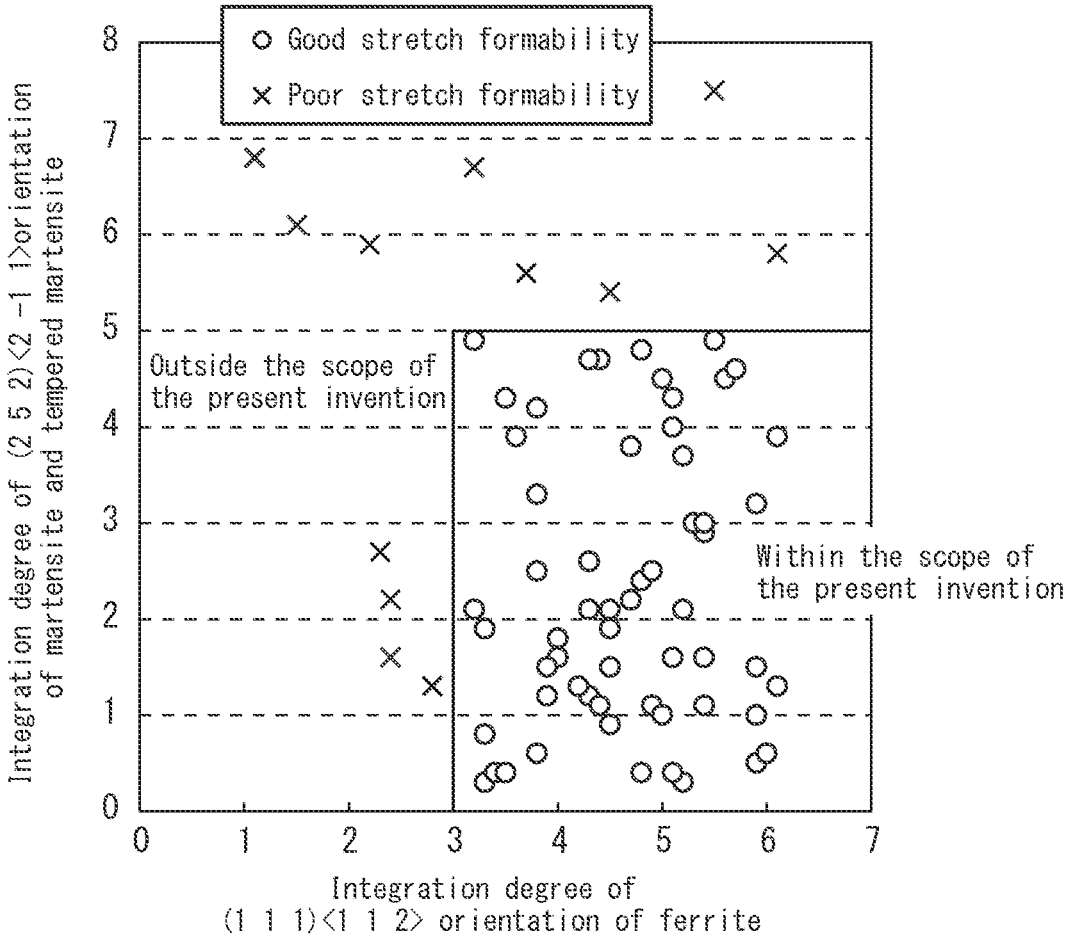
Good stretch formability
Poor stretch formability
Outside the scope of the present invention
Within the scope of the present invention
Integration degree of (2 5 2)<2 -1 1>orientation of martensite and tempered martensite
Integration degree of (1 1 1)<1 1 2> orientation of ferrite
0
1
2
3
4
5
6
7
8

STEEL SHEET AND METHOD OF PRODUCING SAME

FIELD

The present invention relates to a steel sheet and a method of producing the same. More particularly, the present invention relates to a high-strength steel sheet having excellent stretch formability, and a method of producing the same.

BACKGROUND

In order to improve the stretch formability of a DP steel (dual-phase steel mainly composed of ferrite and martensite) having a tensile strength of 550 MPa or higher and 1,100 MPa or lower, it is desirable to integrate the crystal orientation of b.c.c. (body-centered cubic lattice) to γ-fibers. In addition, it is necessary to reduce the integration of the orientation to other than γ-fibers as much as possible. In DP steels, a high strength is achieved by utilizing martensite structure; however, martensite is sometimes accumulated in a specific orientation. This is caused by the formation of an austenite crystallographic texture and, specifically, the formation of an austenite crystallographic texture in the orientations referred to as "copper orientation" and "brass orientation" leads to the formation of a crystallographic texture in martensite that is generated when austenite is cooled. The information of this martensite crystallographic texture is expressed by ODF (crystal orientation distribution function) (φ2=45°); however, since the martensite crystallographic texture exists on γ-fibers, it is difficult to recognize the difference thereof from parent-phase ferrite.

Numerous inventions relating to DP steels and high-strength steel sheets have been disclosed to date; however, only a handful of them disclose a technology relating to an improvement of the stretch formability (see, for example, PTLs 1 to 4).

PTL 1 discloses a technology relating to a high-tensile-strength hot-rolled steel sheet having high formability with excellent stretch flange formability and fatigue characteristics as well as good stretch formability and shape fixability, in which a steel slab containing C: 0.01 to 0.10% by weight, Si: 0.50 to 1.50% by weight, Mn: 0.50 to 2.50% by weight, P: 0.05% by weight or less, S: 0.005% by weight or less, and Ti: 0.005 to 0.03% by weight is retained in a temperature range of 900 to 1,300° C., subsequently continuously hot rolled at a rolling reduction ratio of lower than 20% in the final stand and a rolling termination temperature of 870 to 980° C., cooled at a cooling rate of 50 to 200° C./sec after the completion of the rolling, and then wound in a coil form in a temperature range of 300 to 650° C., whereby a structure which is composed of a ferrite phase having a volume ratio of 70 to 97% and the remainder being a low-temperature transformed phase mainly constituted by a bainite phase is formed, and the in-plane anisotropy Δr of r value is controlled to be 0.2 or less. It is noted here, however, that PTL1 does not offer a technology for ensuring the formability for the case of a steel structure containing martensite structure beneficial for improvement of the strength.

PTL 2 discloses a technology relating to a high-strength cold-rolled steel sheet having a small in-plane anisotropy of elongation and a tensile strength (TS) of 440 MPa or higher with excellent press formability, in which the steel sheet has a composition containing, by mass %, C: 0.030 to 0.20%, Si: 1.5% or less, Mn: 1.0 to 2.5%, P: 0.005 to 0.1%, S: 0.01% or less, Al: 0.005 to 1.5%, N: 0.01%, and the balance of Fe and unavoidable impurities, and the steel sheet contains, by area ratio with respect to the whole steel sheet structure: 85% to 99% of a ferrite phase as parent phase; and 1% to 15% of a second phase containing a martensite phase, the area ratio of the martensite phase with respect to the whole steel sheet structure is 1% to 13%, and the average crystal orientation density (I) of α fibers in a range of Φ=25 to 35°, which is expressed by an ODF (crystal orientation distribution function), is 2.0 to 4.0 in the crystallographic texture of a sheet plane at a ¼-thickness position of the steel sheet. In this technology, the area ratio of the martensite structure is reduced to decrease the in-plane anisotropy and, therefore, a high strength and a high ductility, which are characteristics of a DP steel, cannot be obtained. It can be understood also from this disclosed technology that it is necessary to modify the martensite structure in order to improve the stretch formability while maintaining the characteristics of a conventional DP steel.

PTL 3 discloses a high-strength hot-dip galvanized steel sheet having excellent formability along with a TS of 780 MPa or higher, excellent elongation El and a TS×EL value of 18,000 or more, wherein the steel sheet has a component composition that contains, by mass %, C: 0.03 to 0.15%, Si: 0.8 to 2.5%, Mn: 1.0 to 3.0%, P: 0.001 to 0.05%, S: 0.0001 to 0.01%, Al: 0.001 to 0.1%, N: 0.0005 to 0.01%, Cr: 0.1 to 2.0%, and the balance of Fe and unavoidable impurities, and has a microstructure that contains, by area ratio, 50% or more of a ferrite phase and 10% or more of a martensite phase. In PTL 3, only a technology of improving the bulging height by providing the steel sheet surface with a plated coating film and a post-treatment coating film is disclosed, and no technology is presented with regard to the isotropy of the shape after forming, which is an important indicator of stretch formability.

PTL 4 discloses a high-strength steel sheet with excellent workability, which has a tensile strength of 590 MPa or higher and in which uniform elongation and hole expansion are improved simultaneously, wherein the steel sheet contains, by mass %, C: 0.04 to 0.10%, Mn: 0.5 to 2.6%, and Si: 0.8 to 2.0%, the ratio (C/Si) of the C content to the Si content being 0.04 or more and less than 0.10; the content of Al, P, S and N being restricted; and the steel sheet comprises a metallographic structure composed of, by volume ratio, 90 to 95% of ferrite and 5 to 10% of tempered martensite. This disclosed technology is nothing more than a means of tempering the martensite structure and reducing the area ratio of tempered martensite for an improvement the workability; therefore, PTL 4 still has room for improvement in terms of improving the stretch formability.

In addition to the above, for example, PTLs 5 to 7 each disclose a technology relating to a high-strength steel sheet; however, the stretch formability is not examined at all in these PTLs.

CITATION LIST

Patent Literature

[PTL 1] JP 2000-297349 A
[PTL 2] JP 2009-132981 A
[PTL 3] JP 2010-236027 A
[PTL 4] JP 2011-032543 A
[PTL 5] JP 2016-130357 A
[PTL 6] JP 2016-130355 A
[PTL 7] JP 2015-193897 A

SUMMARY

Technical Problem

In view of the above-described circumstances, an object of the present invention is to provide a steel sheet having a high strength and excellent stretch formability, and a method of producing the same.

Solution to Problem

The present inventors conducted intensively studies on the techniques for solving the above-described problems, and examined the changes in orientation in detail so as to distinguish the development of martensite crystallographic texture. As a result, it was revealed that, by reducing the integration of the orientation referred to as "(252)<2-11>", not only the formation of martensite crystallographic texture can be inhibited (the orientation integration degree of martensite can be randomized), but also the stretch formability can be improved (the anisotropy can be reduced). It was also found that this orientation appears after the transformation of austenite in the copper orientation and the brass orientation into martensite and is not visually recognizable in conventional ODF (φ2=45°).

Further, the present inventors conducted various studies to discover that it is difficult to produce a steel sheet with limited integration of the above-described orientation even if the hot-rolling conditions, the annealing conditions and the like are simply and individually devised, and that such a steel sheet can be produced only by achieving optimization in a so-called consistent process of the hot rolling and annealing step and the like, thereby completing the present invention.

The gist of the present invention is as follows.

(1) A steel sheet, having a chemical composition comprising, by mass %:

C: 0.05 to 0.20%;
Si: 0.01 to 1.30%;
Mn: 1.00 to 3.00%;
P: 0.0001 to 0.0200%;
S: 0.0001 to 0.0200%;
Al: 0.001 to 1.000%;
N: 0.0001 to 0.0200%;
Co: 0 to 0.5000%;
Ni: 0 to 0.5000%;
Mo: 0 to 0.5000%;
Cr: 0 to 1.0000%;
O: 0 to 0.0200%;
Ti: 0 to 0.5000%;
B: 0 to 0.0100%;
Nb: 0 to 0.5000%;
V: 0 to 0.5000%;
Cu: 0 to 0.5000%;
W: 0 to 0.1000%;
Ta: 0 to 0.1000%;
Sn: 0 to 0.0500%;
Sb: 0 to 0.0500%;
As: 0 to 0.0500%;
Mg: 0 to 0.0500%;
Ca: 0 to 0.0500%;
Y: 0 to 0.0500%;
Zr: 0 to 0.0500%;
La: 0 to 0.0500%;
Ce: 0 to 0.0500%; and
a balance of Fe and impurities,
wherein the steel sheet comprises, by area ratio:

a total of ferrite and bainite: 10.0 to 90.0%;

a total of martensite and tempered martensite: 5.0 to 80.0%; and a total of pearlite and retained austenite: 0 to 15.0%, integration degree of (111)<112> orientation of ferrite is 3.0 or higher; and integration degree of (252)<2-11> orientation of martensite and tempered martensite is 5.0 or lower.

(2) The steel sheet according to (1), containing one or more of:

Co: 0.0001 to 0.5000%;
Ni: 0.0001 to 0.5000%;
Mo: 0.0001 to 0.5000%;
Cr: 0.0001 to 1.0000%;
O: 0.0001 to 0.0200%;
Ti: 0.0001 to 0.5000%;
B: 0.0001 to 0.0100%;
Nb: 0.0001 to 0.5000%;
V: 0.0001 to 0.5000%;
Cu: 0.0001 to 0.5000%;
W: 0.0001 to 0.1000%;
Ta: 0.0001 to 0.1000%;
Sn: 0.0001 to 0.0500%;
Sb: 0.0001 to 0.0500%;
As: 0.0001 to 0.0500%;
Mg: 0.0001 to 0.0500%;
Ca: 0.0001 to 0.0500%;
Y: 0.0001 to 0.0500%;
Zr: 0.0001 to 0.0500%;
La: 0.0001 to 0.0500%; and
Ce: 0.0001 to 0.0500%.

(3) A method of producing a steel sheet, the method comprising:

a casting step of continuously casting a molten steel having the chemical composition according to (1) or (2) to form a slab, wherein 5 to 40% rolling reduction is performed at a temperature of 800° C. to lower than 1,200° C. in a period after the continuous casting and before cooling to room temperature;

a hot rolling step which includes hot rolling the slab and in which a finishing temperature of the hot rolling is 650 to 950° C.;

a step of coiling the thus obtained hot-rolled steel sheet at a coiling temperature of 400 to 700° C.;

a step of retaining the thus coiled hot-rolled steel sheet as is wherein the thus coiled hot-rolled steel sheet is not cooled to room temperature before retaining and is retained in a temperature range of (coiling start temperature+20° C. to 100° C.) for 5 to 300 minutes;

a cold rolling step of cold rolling the hot-rolled steel sheet at a rolling reduction ratio of 10.0 to 90.0%; and an annealing step of annealing the thus obtained cold-rolled steel sheet in a temperature range of 700 to 900° C.

Advantageous Effects of Invention

According to the present invention, a steel sheet having a high strength and excellent stretch formability, and a method of producing the same can be provided.

BRIEF DESCRIPTION OF DRAWING

FIG. 1 is a graph showing the effects of the integration degree of the (111)<112> orientation of ferrite and the integration degree of the (252)<2-11> orientation of martensite and tempered martensite on the stretch formability of the DP steels used in Examples 1 and 2.

DESCRIPTION OF EMBODIMENTS

Embodiments of the present invention will now be described. It is noted here, however, the following descriptions are merely intended for exemplification of the embodiments of the present invention, and the present invention is not limited to the below-described embodiments.

<Steel Sheet>

The steel sheet according to one embodiment of the present invention has a chemical composition comprising, by mass %:

C: 0.05 to 0.20%;
Si: 0.01 to 1.30%;
Mn: 1.00 to 3.00%;
P: 0.0001 to 0.0200%;
S: 0.0001 to 0.0200%;
Al: 0.001 to 1.000%;
N: 0.0001 to 0.0200%;
Co: 0 to 0.5000%;
Ni: 0 to 0.5000%;
Mo: 0 to 0.5000%;
Cr: 0 to 1.0000%;
O: 0 to 0.0200%;
Ti: 0 to 0.5000%;
B: 0 to 0.0100%;
Nb: 0 to 0.5000%;
V: 0 to 0.5000%;
Cu: 0 to 0.5000%;
W: 0 to 0.1000%;
Ta: 0 to 0.1000%;
Sn: 0 to 0.0500%;
Sb: 0 to 0.0500%;
As: 0 to 0.0500%;
Mg: 0 to 0.0500%;
Ca: 0 to 0.0500%;
Y: 0 to 0.0500%;
Zr: 0 to 0.0500%;
La: 0 to 0.0500%;
Ce: 0 to 0.0500%; and
a balance of Fe and impurities,
wherein
the steel sheet comprises, by area ratio:
a total of ferrite and bainite: 10.0 to 90.0%;
a total of martensite and tempered martensite: 5.0 to 80.0%; and
a total of pearlite and retained austenite: 0 to 15.0%,
the integration degree of the (111)<112> orientation of ferrite is 3.0 or higher; and
the integration degree of (252)<2-11> orientation of martensite and tempered martensite is 5.0 or lower.

First, the reasons for restricting the chemical components of the steel sheet according to one embodiment of the present invention will be described. Hereinafter, "%" used for each component means "% by mass".

(C: 0.05 to 0.20%)

C is an element which inexpensively increases the tensile strength, and is an extremely important factor for controlling the orientation integration degree of ferrite and bainite or martensite and tempered martensite. When the C content is less than 0.05%, retained austenite cannot be stabilized at the time of hot rolling and coiling, and the orientation integration degree of martensite cannot be randomized. Accordingly, a lower limit value is set at 0.05% or more. The C content may be 0.06% or more, 0.07% or more, or 0.08% or more. When the C content is more than 0.20%, the stretch formability is deteriorated since such a C content causes not only a reduction in elongation but also a reduction of the orientation integration degree of ferrite. Accordingly, an upper limit value is set at 0.20% or less. The C content may be 0.18% or less, 0.16% or less, or 0.15% or less.

(Si: 0.01 to 1.30%)

Si is an element which acts as a deoxidizer and affects the form of carbides and heat-treated retained austenite. In order to satisfy both wear resistance and stretch formability, it is effective to improve the strength by reducing the volume ratio of carbides existing in a steel component and utilizing retained austenite. When the Si content is less than 0.01%, the generation of carbides is not inhibited and a large amount of carbides thus exists in the steel, as a result of which the stretch formability is deteriorated. Accordingly, a lower limit value is set at 0.01% or more. The Si content may be 0.05% or more, 0.10% or more, or 0.30% or more. Further, the Si content of more than 1.30% causes an increase in the steel strength and embrittlement of the steel component, consequently deteriorating the stretch formability. Accordingly, an upper limit value is set at 1.30% or less. The Si content may be 1.20% or less, 1.10% or less, 1.00% or less, or 0.90% or less.

(Mn: 1.00 to 3.00%)

Mn, which is a factor affecting ferrite transformation of steel, is an element effective for improving the strength. When the Mn content is less than 1.00%, martensitic transformation cannot be facilitated in the cooling process of cold-rolled sheet annealing, and this causes a reduction in the strength. Accordingly, a lower limit value is set at 1.00% or more. The Mn content may be 1.10% or more, 1.30% or more, or 1.50% or more. When the Mn content is more than 3.00%, the stretch formability is deteriorated since ferrite transformation and bainite transformation in cold-rolled sheet annealing are inhibited. Accordingly, an upper limit value is set at 3.00% or less. The Mn content may be 2.80% or less, 2.50% or less, or 2.20% or less.

(P: 0.0001 to 0.0200%)

P is an element which is strongly segregated at ferrite grain boundaries to facilitate embrittlement of the grain boundaries. The lower the P content, the more preferred it is. When the P content is less than 0.0001%, a long time is required for refining to increase the purity, and this leads to a significant increase in the cost. Accordingly, a lower limit value is set at 0.0001% or more. The P content may be 0.0005% or more, 0.0010% or more, or 0.0020% or more. When the P content is more than 0.0200%, the stretch formability is deteriorated due to grain boundary embrittlement. Accordingly, an upper limit value is set at 0.0200% or less. The P content may be 0.0180% or less, 0.0150% or less, or 0.0120% or less.

(S: 0.0001 to 0.0200%)

S is an element which generates non-metallic inclusions such as MnS in steel and causes a reduction in the ductility of a steel component. The lower the S content, the more preferred it is. When the S content is less than 0.0001%, a long time is required for refining to increase the purity, and this leads to a significant increase in the cost. Accordingly, a lower limit value is set at 0.0001% or more. The S content may be 0.0005% or more, 0.0010% or more, or 0.0020% or more. When the S content is more than 0.0200%, the stretch formability is deteriorated since such an S content causes cracking that originate from non-metallic inclusions during cold forming. Accordingly, an upper limit value is set at 0.0200% or less. The S content may be 0.0180% or less, 0.0150% or less, or 0.0120% or less.

(Al: 0.001 to 1.000%)

Al is an element which acts as a deoxidizer of steel and stabilizes ferrite, and Al is added as required. When the Al content is less than 0.001%, the effect of the addition is not sufficiently obtained. Accordingly, a lower limit value is set at 0.001% or more. The Al content may be 0.005% or more, 0.010% or more, or 0.020% or more. When the Al content is more than 1.000%, the strength of the steel sheet is reduced since ferrite transformation and bainite transformation are excessively facilitated in the cooling process of cold-rolled sheet annealing. Accordingly, an upper limit value is set at 1.000% or less. The Al content may be 0.950% or less, 0.900% or less, or 0.800% or less.

(N: 0.0001 to 0.0200%)

N is an element which forms coarse nitrides in the steel sheet and deteriorates the workability of the steel sheet. N is also an element which causes generation of blow-holes in welding. An N content of less than 0.0001% leads to a significant increase in the production cost. Accordingly, a lower limit value is set at 0.0001% or more. The N content may be 0.0005% or more, 0.0010% or more, or 0.0020% or more. When the N content is more than 0.0200%, deterioration of the stretch formability and generation of blow-holes become prominent. Accordingly, an upper limit value is set at 0.0200% or less. The N content may be 0.0180% or less, 0.0160% or less, or 0.0120% or less.

The basic chemical composition of the steel sheet according to one embodiment of the present invention is as described above. The steel sheet may further contain the following elements as required. The steel sheet may contain the following elements in place of a part of the balance of Fe.

(Co: 0 to 0.5000%)

Co is an element effective for controlling the form of carbides and improving the strength, and it is added as required. When the Co content is less than 0.0001%, the effects of the addition are not obtained. Accordingly, a lower limit value is preferably set at 0.0001% or more. The Co content may be 0.0002% or more, 0.0010% or more, or 0.0100% or more. When the Co content is more than 0.5000%, fine Co carbide precipitates in a large amount, and this causes an increase in the strength and a reduction in the ductility of the steel material, as a result of which the cold workability and the stretch formability may be deteriorated. Accordingly, an upper limit value is set at 0.5000% or less. The Co content may be 0.4500% or less, 0.4000% or less, or 0.3000% or less.

(Ni: 0 to 0.5000%)

Ni is a reinforcing element and is effective for improving the hardenability. In addition, Ni may be added since it improves the wettability and facilitates an alloying reaction. When the Ni content is less than 0.0001%, these effects are not obtained. Accordingly, a lower limit value is preferably set at 0.0001% or more. The Ni content may be 0.0002% or more, 0.0010% or more, or 0.0100% or more. When the Ni content is more than 0.5000%, the productivity in the production and in hot rolling may be adversely affected, or the stretch formability may be deteriorated. Accordingly, an upper limit value is set at 0.5000% or less. The Ni content may be 0.4500% or less, 0.4000% or less, or 0.3000% or less.

(Mo: 0 to 0.5000%)

Mo is an element effective for improving the strength of the steel sheet. Further, Mo is an element which has an effect of inhibiting ferrite transformation that occurs during a heat treatment performed in a continuous annealing equipment or continuous hot-dip galvanizing equipment. When the Mo content is less than 0.0001%, these effects are not obtained. Accordingly, a lower limit value is preferably set at 0.0001% or more. The Mo content may be 0.0002% or more, 0.0010% or more, or 0.0100% or more. When the Mo content is more than 0.5000%, the formability, particularly the stretch formability may be deteriorated since not only ferrite transformation and bainite transformation are inhibited but also martensitic transformation is facilitated during cold-rolled sheet annealing. Accordingly, an upper limit value is set at 0.5000% or less. The Mo content may be 0.4500% or less, 0.4000% or less, or 0.3000% or less.

(Cr: 0 to 1.0000%)

Similarly to Mn, Cr is an element which inhibits pearlite transformation and is effective for improving the steel strength, and Cr is added as required. When the Cr content is less than 0.0001%, the effects of the addition are not obtained. Accordingly, a lower limit value is preferably set at 0.0001% or more. The Cr content may be 0.0002% or more, 0.0010% or more, or 0.0100% or more. When the Cr content is more than 1.0000%, the stretch formability may be deteriorated since the stability of austenite is markedly increased and a large amount of retained austenite thus exists after cold-rolled sheet annealing. Accordingly, an upper limit value is set at 1.0000% or less. The Cr content may be 0.9000% or less, 0.8000% or less, or 0.7000% or less.

(O: 0 to 0.0200%)

O forms oxides and deteriorates the workability; therefore, the amount thereof to be added needs to be kept small. Particularly, the oxides often exist in the form of inclusions and, when such oxides exist on a punched end surface or a cut surface, notch-like defects and coarse dimples are formed on the end surface, as a result of which stress concentration is induced during stretch forming and severe working, and the workability is significantly deteriorated with such defects and dimples serving as the origin of crack formation. However, an O content of less than 0.0001% is not economically preferred since it leads to an excessively high cost. Accordingly, a lower limit value is preferably set at 0.0001% or more. The O content may be 0.0005% or more, 0.0010% or more, or 0.0020% or more. Meanwhile, when the O content is more than 0.0200%, the above-described tendency of workability deterioration is pronounced. Accordingly, an upper limit value is set at 0.0200% or less. The O content may be 0.0180% or less, 0.0150% or less, or 0.0100% or less.

(Ti: 0 to 0.5000%)

Ti is a reinforcing element. Ti contributes to an increase in the strength of the steel sheet through strengthening by precipitates, fine-grain strengthening by the inhibition of the growth of ferrite crystal grains, and dislocation strengthening by the inhibition of recrystallization. When the Ti content is less than 0.0001%, these effects are not obtained. Accordingly, a lower limit value is preferably set at 0.0001% or more. Ti content may be 0.0002% or more, 0.0010% or more, or 0.0100% or more. When the Ti content is more than 0.5000%, the formability, particularly the stretch formability may be deteriorated due to an increased precipitation of carbonitrides. Accordingly, an upper limit value is set at 0.5000% or less. The Ti content may be 0.4500% or less, 0.4000% or less, or 0.3000% or less.

(B: 0 to 0.0100%)

B is an element which inhibits the generation of ferrite and pearlite from austenite in a cooling process and facilitates the generation of a low-temperature transformed structure of bainite, martensite or the like. Further, B is an element beneficial for improving the steel strength, and it is added as required. When the B content is less than 0.0001%, the effect of improving the strength or the wear resistance by the addition is not sufficiently obtained. Moreover, not only the most careful attention must be paid when performing an analysis to identify a B content of less than 0.0001%, but also such a B content may be below the detection limit depending on the analysis equipment. Accordingly, a lower limit value is preferably set at 0.0001% or more. The B content may be 0.0003% or more, 0.0005% or more, or 0.0010% or more. When the B content is more than 0.0100%, coarse B oxide may be generated in the steel, and the stretch formability may be deteriorated with the B oxide serving as the origin of void generation during cold forming. Accordingly, an upper limit value is set at 0.0100% or less. The B content may be 0.0080% or less, 0.0060% or less, or 0.0050% or less.

(Nb: 0 to 0.5000%)

Similarly to Ti, Nb is an element effective for controlling the form of carbides and, since an addition thereof leads to structural refinement, Nb is also an element effective for improving the toughness. When the Nb content is less than 0.0001%, these effects are not obtained. Accordingly, a lower limit value is preferably set at 0.0001% or more. The Nb content may be 0.0002% or more, 0.0010% or more, or 0.0100% or more. When the Nb content is more than 0.5000%, fine and hard Nb carbide precipitates in a large amount, and this causes an increase in the strength and a marked reduction in the ductility of the steel material, as a result of which the cold workability and the stretch formability may be deteriorated. Accordingly, an upper limit value is set at 0.5000% or less. The Nb content may be 0.4500% or less, 0.4000% or less, or 0.3000% or less.

(V: 0 to 0.5000%)

V is a reinforcing element. V contributes to an increase in the strength of the steel sheet through strengthening by precipitates, fine-grain strengthening by the inhibition of the growth of ferrite crystal grains, and dislocation strengthening by the inhibition of recrystallization. When the V content is less than 0.0001%, these effects are not obtained. Accordingly, a lower limit value is preferably set at 0.0001% or more. The V content may be 0.0002% or more, 0.0010% or more, or 0.0100% or more. When the V content is more than 0.5000%, the formability, particularly the stretch formability is deteriorated due to an increased precipitation of carbonitrides. Accordingly, an upper limit value is set at 0.5000% or less. The V content may be 0.4500% or less, 0.4000% or less, or 0.3000% or less.

(Cu: 0 to 0.5000%)

Cu is an element effective for improving the strength of the steel sheet. When the Cu content is less than 0.0001%, this effect is not obtained. Accordingly, a lower limit value is preferably set at 0.0001% or more. The Cu content may be 0.0002% or more, 0.0010% or more, or 0.0100% or more. When the Cu content is more than 0.5000%, the steel material is embrittled during hot rolling, making it impossible to perform hot rolling. In addition, the stretch formability may be deteriorated due to a marked increase in the steel strength. Accordingly, an upper limit value is set at 0.5000% or less. The Cu content may be 0.4500% or less, 0.4000% or less, or 0.3000% or less.

(W: 0 to 0.1000%)

W is an extremely important element not only because it is effective for improving the strength of the steel sheet, but also because W-containing precipitates and crystals act as hydrogen trapping sites. When the W content is less than 0.0001%, these effects are not obtained. Accordingly, a lower limit value is preferably set at 0.0001% or more. The W content may be 0.0002% or more, 0.0010% or more, or 0.0050% or more. When the W content is more than 0.1000%, the workability, particularly the stretch formability may be deteriorated. Accordingly, an upper limit value is set at 0.1000% or less. The W content may be 0.0800% or less, 0.0600% or less, or 0.0500% or less.

(Ta: 0 to 0.1000%)

Similarly to Nb, V and W, Ta is an element effective for controlling the form of carbides and improving the strength, and Ta is added as required. When the Ta content is less than 0.0001%, the effects of the addition are not obtained. Accordingly, a lower limit value is preferably set at 0.0001% or more. The Ta content may be 0.0002% or more, 0.0010% or more, or 0.0050% or more. When the Ta content is more than 0.1000%, fine Ta carbide is precipitated in a large amount, and this causes an increase in the strength and a reduction in the ductility of the steel sheet, as a result of which the bending resistance and the stretch formability may be deteriorated. Accordingly, an upper limit value is set at 0.1000% or less. The Ta content may be 0.0800% or less, 0.0600% or less, or 0.0500% or less.

(Sn: 0 to 0.0500%)

Sn is an element which is incorporated into steel when scrap is used as a raw material, and the lower the Sn content, the more preferred it is. An Sn content of less than 0.0001%, however, leads to an increase in the refining cost. Accordingly, a lower limit value is preferably set at 0.0001% or more. The Sn content may be 0.0002% or more, 0.0010% or more, or 0.0050% or more. When the Sn content is more than 0.0500%, the stretch formability may be deteriorated due to embrittlement of ferrite. Accordingly, an upper limit value is set at 0.0500% or less. The Sn content may be 0.0400% or less, 0.0300% or less, or 0.0200% or less.

(Sb: 0 to 0.0500%)

Similarly to Sn, Sb is an element which is incorporated when scrap is used as a steel raw material. Sb is strongly segregated at grain boundaries and causes embrittlement of the grain boundaries and a reduction of the ductility; therefore, the lower the Sb content, the more preferred it is, and the Sb content may be 0%. An Sb content of less than 0.0001%, however, leads to an increase in the refining cost. Accordingly, a lower limit value is preferably set at 0.0001% or more. The Sb content may be 0.0002% or more, 0.0010% or more, or 0.0050% or more. When the Sb content is more than 0.0500%, the stretch formability may be deteriorated. Accordingly, an upper limit value is set at 0.0500% or less. The Sb content may be 0.0400% or less, 0.0300% or less, or 0.0200% or less.

(As: 0 to 0.0500%)

Similarly to Sn and Sb, As is an element which is incorporated when scrap is used as a steel raw material, and is strongly segregated at grain boundaries. The lower the As content, the more preferred it is. An As content of less than 0.0001%, however, leads to an increase in the refining cost. Accordingly, a lower limit value is preferably set at 0.0001% or more. The As content may be 0.0002% or more, 0.0010% or more, or 0.0050% or more. When the As content is more than 0.0500%, the stretch formability is deteriorated. Accordingly, an upper limit value is set at 0.0500% or less. The As content may be 0.0400% or less, 0.0300% or less, or 0.0200% or less.

(Mg: 0 to 0.0500%)

Mg is an element which can control the form of sulfides when added in a trace amount, and it is added as required. When the Mg content is less than 0.0001%, this effect is not obtained. Accordingly, a lower limit value is preferably set at 0.0001% or more. The Mg content may be 0.0002% or more, 0.0010% or more, or 0.0050% or more. When the Mg content is more than 0.0500%, the stretch formability may be deteriorated due to the formation of coarse inclusions. Accordingly, an upper limit value is set at 0.0500% or less. The Mg content may be 0.0400% or less, 0.0300% or less, or 0.0200% or less.

(Ca: 0 to 0.0500%)

Ca is useful as a deoxidizing element and also exerts an effect in controlling the form of sulfides. When the Ca content is less than 0.0001%, the effects of Ca are not sufficiently obtained. Accordingly, a lower limit value is preferably set at 0.0001% or more. The Ca content may be 0.0002% or more, 0.0010% or more, or 0.0050% or more. When the Ca content is more than 0.0500%, the workability, particularly the stretch formability may be deteriorated. Accordingly, an upper limit value is set at 0.0500% or less. The Ca content may be 0.0400% or less, 0.0300% or less, or 0.0200% or less.

(Y: 0 to 0.0500%)

Similarly to Mg and Ca, Y is an element which can control the form of sulfides when added in a trace amount, and it is added as required. When the Y content is less than 0.0001%, this effect is not obtained. Accordingly, a lower limit value is preferably set at 0.0001% or more. The Y content may be 0.0002% or more, 0.0010% or more, or 0.0050% or more. When the Y content is more than 0.0500%, the stretch formability may be deteriorated due to the formation of coarse Y oxide. Accordingly, an upper limit value is set at 0.0500% or less. The Y content may be 0.0400% or less, 0.0300% or less, or 0.0200% or less.

(Zr: 0 to 0.0500%)

Similarly to Mg, Ca and Y, Zr is an element which can control the form of sulfides when added in a trace amount, and it is added as required. When the Zr content is less than 0.0001%, this effect is not obtained. Accordingly, a lower limit value is preferably set at 0.0001% or more. The Zr content may be 0.0002% or more, 0.0010% or more, or 0.0050% or more. When the Zr content is more than 0.0500%, the stretch formability may be deteriorated due to the formation of coarse Zr oxide. Accordingly, an upper limit value is set at 0.0500% or less. The Zr content may be 0.0400% or less, 0.0300% or less, or 0.0200% or less.

(La: 0 to 0.0500%)

La is an element which is effective for controlling the form of sulfides when added in a trace amount, and it is added as required. When the La content is less than 0.0001%, this effect is not obtained. Accordingly, a lower limit value is preferably set at 0.0001% or more. The La content may be 0.0002% or more, 0.0010% or more, or 0.0050% or more. When the La content is more than 0.0500%, the stretch formability may be deteriorated due to the formation of La oxide. Accordingly, an upper limit value is set at 0.0500% or less. The La content may be 0.0400% or less, 0.0300% or less, or 0.0200% or less.

(Ce: 0 to 0.0500%)

Similar to La, Ce is an element which can control the form of sulfides when added in a trace amount, and it is added as required. When the Ce content is less than 0.0001%, this effect is not obtained. Accordingly, a lower limit value is preferably set at 0.0001% or more. The Ce content may be 0.0002% or more, 0.0010% or more, or 0.0050% or more. When the Ce content is more than 0.0500%, the stretch formability may be deteriorated due to the formation of Ce oxide. Accordingly, an upper limit value is set at 0.0500% or less. The Ce content may be 0.0400% or less, 0.0300% or less, or 0.0200% or less.

In the steel sheet according to one embodiment of the present invention, the remainder other than the above-described components is composed of Fe and impurities. The term "impurities" used herein includes components which are incorporated due to various factors of the production process during the industrial production of a steel sheet, such as raw materials including ore, scrap and the like, and are not intentionally added to the steel sheet according to one embodiment of the present invention (so-called unavoidable impurities). The term "impurities" also includes elements other than the above-described components, which elements are contained in the steel sheet according to one embodiment of the present invention at a level that the actions and effects unique to the respective elements do not affect the properties of the steel sheet.

Next, the characteristic features of the structure and properties of the steel sheet according to one embodiment of the present invention will be described.

(Total of Ferrite and Bainite: 10.0 to 90.0%)

The total area ratio of ferrite and bainite affects the elongation of steel, and the workability is improved as the area ratio increases. A total area ratio of lower than 10.0% requires an advanced control in the production; therefore, the yield may be reduced and the stretch formability may be deteriorated. Accordingly, a lower limit value is set at 10.0% or higher. The total area ratio of ferrite and bainite may be 20.0% or higher, 30.0% or higher, or 35.0% or higher. When the total area ratio is higher than 90%, the strength may be reduced. Accordingly, an upper limit value is set at 90.0% or lower. The total area ratio of ferrite and bainite may be 85.0% or lower, 80.0% or lower, or 75.0% or lower.

(Total of Martensite and Tempered Martensite: 5.0 to 80.0%)

The total area ratio of martensite and tempered martensite affects the steel strength, and the tensile strength is increased as the area ratio increases. At lower than 5.0%, the area ratio of martensite and tempered martensite is not sufficient, and a target tensile strength of 550 MPa or higher may not be achieved. Accordingly, a lower limit value is set at 5.0% or higher. The total area ratio of martensite and tempered martensite may be 10.0% or higher, 15.0% or higher, or 20.0% or higher. When the total area ratio is higher than 80.0%, the tensile strength may exceed 1,100 MPa to cause deterioration of the strength-ductility balance and the stretch formability. Accordingly, an upper limit value is set at 80.0% or lower. The total area ratio of martensite and tempered martensite may be 70.0% or lower, 60.0% or lower, or 55.0% or lower.

(Total of Pearlite and Retained Austenite: 0 to 15.0%)

Pearlite and retained austenite of the balance are structural factors that deteriorate the local ductility of steel; therefore, the lower the content thereof, the more preferred it is. The total area ratio of pearlite and retained austenite may be 0%; however, a total area ratio of lower than 1.0% may require an advanced control in the production. From the standpoint of preventing a reduction in the yield, the total area ratio of pearlite and retained austenite can be set at 1.0% or higher. The total area ratio of pearlite and retained austenite may be 2.0% or higher, 3.0% or higher, or 5.0% or higher. When this total area ratio is higher than 15.0%, the stretch formability may be deteriorated. Accordingly, an upper limit value is set at 15.0% or lower. The total area ratio of pearlite and retained austenite may be 13.0% or lower, 11.0% or lower, or 9.0% or lower.

(Integration Degree of (111)<112> Orientation of Ferrite: 3.0 or Higher)

The integration degree of the (111)<112> orientation of ferrite is a factor that affects isotropic deformation of steel, i.e. stretch formability, and the higher this integration degree, the better the stretch formability. When the integration degree is lower than 3.0, good stretch formability cannot be obtained. Accordingly, a lower limit value is set at 3.0 or higher. The integration degree is preferably 4.0 or higher, or 5.0 or higher. An upper limit value of this integration degree is not particularly limited, and it may be 10.0 or lower, 8.0 or lower, or 7.0 or lower.

(Integration Degree of (252)<2-11> Orientation of Martensite and Tempered Martensite: 5.0 or Lower)

The integration degree of the (252)<2-11> orientation of martensite and tempered martensite in total is a factor that inhibits isotropic deformation of steel, i.e. a factor that affects the stretch formability, and the lower this integration degree, the better the stretch formability. When the integration degree is higher than 5.0, the stretch formability is deteriorated. Accordingly, an upper limit value is set at 5.0 or lower. The integration degree is preferably 4.0 or lower, or 3.0 or lower. A lower limit value of this integration degree is not particularly limited, and it may be 0.1 or higher, 0.2 or higher, or 0.3 or higher.

(Sheet Thickness)

The thickness of the steel sheet is a factor that affects the rigidity of a steel member after forming, and the greater the sheet thickness, the higher the rigidity of the member. When the sheet thickness is less than 0.2 mm, not only the rigidity is reduced but also the stretch formability is deteriorated due to the effects of unavoidable non-metallic inclusions existing in the steel material; therefore, the sheet thickness is preferably 0.2 mm or greater. However, when the sheet thickness is greater than 3.0 mm, the forming load is increased at the time of stretch forming, and this causes wear of a die and deterioration of the productivity; therefore, the sheet thickness is preferably 3.0 mm or less.

Next, method of observing and measuring the above-prescribed structures will be described.

(Method of Evaluating Total Area Ratio of Ferrite and Bainite)

The area ratio of ferrite and bainite is determined by observing a portion in a range of ⅛ to ⅜ of the sheet thickness that is centered at the ¼-thickness position on an electron channeling contrast image under a field emission-scanning electron microscope (FE-SEM). Electron channeling contrast imaging is a technique for detecting misorientation in crystal grains as a difference in contrast and, on the thus obtained image, polygonal ferrite is observed as a part having a uniform contrast within a structure judged as ferrite, not pearlite, bainite, martensite or retained austenite. Bainite is a collection of lath-like crystal grains inside of which iron-based carbides with a major axis of 20 nm or longer are not contained, or inside of which iron-based carbides with a major axis of 20 nm or longer are contained and the carbides belong to a single variant, i.e. a group of iron-based carbides extending in the direction. The phrase "group of iron-based carbides extending in the same direction" used herein refers to a group of iron-based carbides in which a difference in the extension direction is within 5°. Bainite surrounded by grain boundaries having an orientation difference of 15° or larger is counted as a single bainite grain. The total area ratio of ferrite and bainite is determined by an image analysis method for each of eight viewing fields on a 35 μm×25 μm electron channeling contrast image, and an average value thereof is defined as the total area ratio of ferrite and bainite.

(Method of Evaluating Total Area Ratio of Martensite and Tempered Martensite)

The total area ratio of martensite and tempered martensite is also determined from the above-described image taken by electron channeling contrast imaging. The structures of martensite and tempered martensite are less likely to be etched than ferrite and thus exist as protrusions on the structure observation surface. It is noted here that tempered martensite is a collection of lath-like crystal grains, inside of which iron-based carbides with a major axis of 20 nm or longer are contained and the carbides belong to plural variants, i.e. plural groups of iron-based carbides extending in different directions. Further, retained austenite also exist as protrusions on the structure observation surface. Therefore, the total area ratio of martensite and tempered martensite can be accurately measured by subtracting the area ratio of retained austenite that is determined by the below-described procedures from the area ratio of the protrusions that is determined by the above-described procedures.

(Method of Evaluating Total Area Ratio of Pearlite and Retained Austenite)

The area ratio of retained austenite can be determined by a measurement using an X-ray. In other words, a portion of a sample from a sheet surface to the ¼-depth position in the sheet thickness direction is removed by mechanical polishing and chemical polishing. Subsequently, the fraction of retained austenite structure is calculated from the integrated intensity ratios of the (200) and (211) diffraction peaks of the bcc phase and the (200), (220) and (311) diffraction peaks of the fcc phase, which are obtained by using MoKα radiation as a characteristic X-ray on the polished sample, and the thus calculated value is defined as the area ratio of retained austenite. Further, the area ratio of pearlite is determined from an image taken by the above-described electron channeling contrast imaging. Pearlite is a structure in which plate-like carbide and ferrite are layered.

(Method of Evaluating Integration Degree of (111)<112> Orientation of Ferrite)

The orientation integration degree of ferrite is measured using an EBSD (Electron Back Scattering Diffraction) apparatus, and can be measured by either an EBSP (Electron Back Scattering Pattern) method or an ECP (Electron Channeling Pattern) method. The orientation integration degree of ferrite may be determined from a three-dimensional crystallographic texture calculated by a vector method based on a {110} pole figure, or from a three-dimensional crystallographic texture calculated by a series expansion method using plural (preferably three or more) pole figures among {110}, {100}, {211}, and {310} pole figures. In the measurement by EBSD, the crystal orientation data at the same position as that of the above-described electron channeling contrast image are obtained with the STEP interval being set at 0.05 μm. The integration degree of the (111)<112> orientation is determined from the crystal orientation data corresponding to ferrite that are obtained by this procedure for eight viewing fields.

(Method of Evaluating Integration Degree of (252)<2-11> Orientation of Martensite and Tempered Martensite in Total)

The orientation integration degree of martensite and tempered martensite is also determined by EBSD. The crystal orientation data collected for the evaluation of the orientation integration degree of ferrite also contain the crystal orientation data of martensite and tempered martensite. In the same manner as in the case of ferrite, the integration degree of the (252)<2-11> orientation is determined from the crystal orientation data of martensite and tempered martensite on an electron channeling contrast image.

(Mechanical Properties)

According to the steel sheet of one embodiment of the present invention, the stretch formability can be improved while achieving a high tensile strength and an excellent strength-ductility balance, specifically a tensile strength of 550 to 1,100 MPa and a total elongation of 10.0% or more.

The tensile strength is preferably 700 MPa or higher, more preferably 800 MPa or higher.

<Method of Producing Steel Sheet>

A method of producing the steel sheet according to one embodiment of the present invention is characterized by coherent management of the hot rolling, cold rolling and annealing conditions with the use of materials in the above-described component ranges. One example of a method of producing a steel sheet will now be described; however, a method of producing the steel sheet according to the present invention is not restricted to the below-described mode.

The method of producing the steel sheet according to one embodiment of the present invention is characterized by including:

a casting step of continuously casting a molten steel having the chemical composition as that described above for the steel sheet to form a slab (steel piece), wherein 5 to 40% rolling reduction is performed at a temperature of 800° C. to lower than 1,200° C. in a period after the continuous casting and before cooling to room temperature;

a hot rolling step which includes hot rolling the slab and in which a finishing temperature of the hot rolling is 650 to 950° C.;

a step of coiling the thus obtained hot-rolled steel sheet at a coiling temperature of 400 to 700° C.;

a step of retaining the thus coiled hot-rolled steel sheet as is in a temperature range of (coiling start temperature+20° C. to 100° C.) for 5 to 300 minutes, without cooling the steel sheet to room temperature;

a cold rolling step of cold rolling the hot-rolled steel sheet at a rolling reduction ratio of 10.0 to 90.0%; and an annealing step of annealing the thus obtained cold-rolled steel sheet in a temperature range of 700 to 900° C.

These steps will now each be described in detail.

(Casting Step)

In the method of producing the steel sheet according to one embodiment of the present invention, first, a slab is formed by continuously casting a molten steel having the same chemical composition as that described above for the steel sheet, and 5 to 40% rolling reduction is subsequently performed at a temperature of 800° C. to lower than 1,200° C. in a period after the continuous casting and before cooling of the slab to room temperature, whereby the uniformity of microsegregation-concentrated parts in the slab is improved (specifically, element-concentrated parts can be finely dispersed in the steel material to reduce the difference in concentration of the element-concentrated parts). When the rolling reduction ratio is lower than 5%, segregation is not eliminated, as a result of which the orientation integration degree of ferrite and bainite is reduced and the stretch formability is deteriorated. By improving the uniformity of the element-concentrated parts in the slab (e.g., improving the uniformity of Mn-concentrated parts), non-recrystallized ferrite is prevented from remaining in the element-concentrated parts after cold rolling and annealing, and the orientation is integrated to the (111) plane of ferrite, so that a stretch-formed section is made likely to isotropically expand. In addition, in the below-described post-coiling retention step, austenite is likely to be generated in the hot-rolled sheet. Accordingly, a lower limit value of the rolling reduction ratio is set at 5% or higher, and the rolling reduction ratio may be 6% or higher, 8% or higher, or 10% or higher. When the rolling reduction ratio is higher than 40%, an increase in the size of the equipment is required, and this leads to a heavy equipment investment and an increase in the cost. Further, since the growth directions of solidified structures are aligned, the orientation integration degree of ferrite and bainite is reduced after cold-rolled sheet annealing due to the effect of the resulting crystallographic texture of the solidified structures, as a result of which the stretch formability is deteriorated. Accordingly, an upper limit value is set at 40% or lower, and it may be 38% or lower, 35% or lower, or 30% or lower.

(Hot Rolling Step)

In the present method, hot rolling is subsequently performed on the cast slab. This hot rolling step can be performed by reheating and hot rolling the cast slab directly, or after once cooling the cast slab. When reheating is performed, the heating temperature of the slab is generally 1,100° C. or higher. An upper limit value thereof is not particularly defined, and may be, for example, 1,250° C. or lower.

(Rough Rolling)

In the present method, for example, rough rolling may be optionally performed on the cast slab before finish-rolling so as to adjust the resulting sheet thickness and the like. The conditions of this rough rolling are not particularly restricted as long as the desired sheet bar dimensions can be ensured.

(Finish Rolling)

Subsequently, finish rolling is performed on the thus obtained slab, or the slab that has been additionally rough rolled as required and, in this process, the finishing temperature (hot-rolling finishing temperature of the hot rolling) is controlled in a range of 650 to 950° C. The hot-rolling finishing temperature is a factor that affects the control of the crystallographic texture of prior austenite grains. When the hot-rolling finishing temperature is lower than 650° C., the rolled crystallographic texture of austenite is developed, and anisotropy is induced in the steel material properties. Accordingly, a lower limit value is set at 650° C. or higher, and the hot-rolling finishing temperature may be 680° C. or higher, or 700° C. or higher. When the hot-rolling finishing temperature is higher than 950° C., since the material is maintained at a high temperature prior to the rolling, abnormal grain growth of austenite occurs, making it difficult to obtain an isotropic crystallographic texture. Accordingly, an upper limit value is set at 950° C. or lower, and the hot-rolling finishing temperature may be 930° C. or lower, or 900° C. or lower.

(Coiling Step)

After the hot rolling step, the thus obtained hot-rolled steel sheet is coiled at a coiling temperature of 400 to 700° C. in the subsequent coiling step. The coiling temperature is an important factor for controlling ferrite and bainite that transform from austenite in the structural change of the hot-rolled sheet. When the coiling temperature is lower than 400° C., even with the below-described post-coiling heating treatment, austenite existing in the hot-rolled sheet after the coiling cannot be transformed into bainite, and a target hot-rolled structure cannot be obtained. In addition, the stretch formability is deteriorated as a result. Accordingly, a lower limit value is set at 400° C. or higher, and the coiling temperature may be 420° C. or higher, or 450° C. or higher. When the coiling temperature is higher than 700° C., the transformation from austenite to ferrite is excessively facilitated during the coiling of the hot-rolled sheet, carbon is concentrated in austenite, and pearlite transformation is proceeded when applicating the below-described post-coiling heating treatment, therefore a target hot-rolled structure cannot be obtained. Accordingly, an upper limit value is set at 700° C. or lower, and the coiling temperature may be 680° C. or lower, or 650° C. or lower.

(Retention Step)

Next, the thus coiled hot-rolled steel sheet is, without being cooled to room temperature before retaining, retained as is in a temperature range of (coiling start temperature+20° C. to 100° C.) over a period of 5 to 300 minutes. Such an increase in the temperature and the retention in the temperature range of (coiling start temperature+20° C. to 100° C.) are extremely important control factors in the present invention. During the process of cooling the hot-rolled sheet and terminating the cooling to the coiling temperature after the hot finish rolling, ferrite transformation or bainite transformation proceeds, and carbon is gradually concentrated to the residual austenite. This reaction also proceeds after the hot-rolled sheet is wound into a coil form, and the Mn concentration on the austenite side of austenite-B.C.C. interface in the hot-rolled sheet structure is reduced by once increasing the temperature after the ferrite transformation or bainite transformation; therefore, the austenite-B.C.C. interface is allowed to move and eventually, stable retained austenite can be obtained in the state of a hot-rolled sheet even at room temperature. As described above, in the method of producing the steel sheet according to one embodiment of the present invention, the uniformity of the element-concentrated parts in the slab is improved by controlling the rolling reduction conditions of the slab in the casting step. By combining this with the temperature retention conditions in the retention step, austenite can be generated and allowed to remain in the resulting hot-rolled sheet more appropriately. This retained austenite stabilized in the state of a hot-rolled sheet remains to exist even after cold rolling. The retained austenite generated in this hot rolled sheet by heat treatment is mixed with austenite generated from the crystallographic texture of ferrite in the K-S relation during cold rolling and annealing, and the crystallographic texture of austenite in the cold-rolled sheet annealing is thereby randomized, as a result of which the integration degree of the (252)<2-11> orientation of martensite in the final product can be reduced. By setting the retention temperature at (coiling start temperature+20° C.) or higher, not only the movement of the interface in the transformation from untransformed austenite to bainite and the growth of bainite structure can be promoted, but also the concentration of carbon to the retained austenite can be facilitated. Further, by controlling the retention temperature at (coiling start temperature+100° C.) or lower, internal oxidation can be inhibited. When the retention time is shorter than 5 minutes, the effects of the present invention cannot be obtained since the stabilization of austenite due to the progress of bainite transformation is insufficient. Accordingly, a lower limit value is set at 5 minutes or longer, and the retention time may be 15 minutes or longer, or 30 minutes or longer. When the retention time is longer than 300 minutes, oxygen is supplied from the steel strip surface to the inside, and internal oxides are thereby formed in the hot-rolled sheet. The "internal oxides" are oxides formed along the grain boundaries, and serve as the origin of cracks when they remain after cold rolling and annealing, causing deterioration of the stretch formability. Accordingly, an upper limit value is set at 300 minutes or shorter, and the retention time may be 250 minutes or shorter, or 200 minutes or shorter.

(Cold Rolling and Annealing Step)

Lastly, the thus obtained hot-rolled steel sheet is, for example, pickled as required, and subsequently cold rolled at a rolling reduction ratio of 10.0 to 90.0% and annealed at a temperature of 700 to 900° C., whereby the steel sheet according to one embodiment of the present invention is obtained. In the method of producing the steel sheet according to one embodiment of the present invention, the retained austenite generated in the hot-rolled sheet in the above-described casting step and retention step and the austenite newly generated by the cold rolling and annealing both remain after the cold rolling and annealing. In other words, different orientations of austenite remain and co-exist. In this manner, by combining the rolling reduction conditions in the casting step, the temperature retention conditions in coiling and the cold-rolling and annealing conditions and thereby allowing different orientations of austenite to remain, the integration degree of the (252)<2-11> orientation of martensite and tempered martensite in the steel sheet to be eventually obtained can be more appropriately and easily reduced. Preferred embodiments of cold rolling, annealing and plating treatment are described below in detail. The descriptions below are, however, merely examples of preferred embodiments of cold rolling, annealing and plating treatment, and should not restrict a method of producing the steel sheet by any means.

(Pickling)

First, prior to the cold rolling, the coiled hot-rolled steel sheet is uncoiled and pickled. By performing this pickling, oxide scales on the surface of the hot-rolled steel sheet can be removed to improve the chemical conversion and plating properties of the resulting cold-rolled steel sheet. The pickling may be performed once or plural separate times.

(Cold-Rolling Reduction Ratio)

The cold-rolling reduction ratio affects the recrystallization behavior of ferrite during the cold rolling and annealing. In addition, the cold-rolling reduction has an effect in that the crystal orientation of the retained austenite existing in the hot-rolled sheet is rotated by the cold rolling, and the crystal orientation of the austenite generated by the cold rolling and annealing is randomized. When the cold-rolling reduction ratio is lower than 10.0%, the orientation integration degree of ferrite is reduced, and the stretch formability is deteriorated. Accordingly, a lower limit value is set at 10.0% or higher, and the cold-rolling reduction ratio may be 15.0% or higher. When the cold-rolling reduction ratio is higher than 90.0%, although ferrite is easily recrystallized, austenite generated in the hot-rolled sheet undergoes strain-induced transformation, and the orientation integration degree of martensite and tempered martensite is increased; therefore, the stretch formability is deteriorated. Accordingly, an upper limit value is set at 90.0% or lower, and the cold-rolling reduction ratio may be 75.0% or lower.

(Cold-Rolled Sheet Annealing)

(Heating Rate)

When the cold-rolled steel sheet is passed through a continuous annealing line or a plating line, the heating rate is not particularly restricted; however, since the productivity may be largely deteriorated at a heating rate of lower than 0.5° C./sec, the heating rate is preferably 0.5° C./sec or higher. On the other hand, a heating rate of higher than 100° C./sec involves an excessively large equipment investment; therefore, the heating rate is preferably 100° C./sec or lower.

(Annealing Temperature)

The annealing temperature is a factor that affects the recrystallization behavior of ferrite. The annealing temperature is also a control factor that affects the behavior of austenite generation and is an extremely important for controlling the strength-ductility balance of steel. When the annealing temperature is lower than 700° C., the amount of generated austenite is small, and undissolved carbides exist even after the retention in the cold rolling and annealing. Further, the transformation from austenite to pearlite is facilitated by the presence of undissolved carbides; therefore, in the resulting cold-rolled and annealed structure, the ratio of martensite structure is reduced while the ratio of pearlite structure is increased. In addition, since non-recrystallized ferrite remains, the stretch formability is deteriorated. Accordingly, a lower limit value is set at 700° C. or higher, and the annealing temperature may be 750° C. or higher. When the annealing temperature is higher than 900° C., since the amount of austenite generated during the retention at a constant temperature in the annealing is increased, the orientation integration degree of ferrite and bainite is reduced in the resulting cold-rolled and annealed structure, as a result of which the stretch formability is deteriorated. Accordingly, an upper limit value is set at 900° C. or lower, and the annealing temperature may be 850° C. or lower.

(Retention Time)

The steel sheet is supplied to a continuous annealing line to perform annealing with heating at the annealing temperature. In this process, the retention time is preferably 10 to 600 seconds. When the retention time is shorter than 10 seconds, the fraction of austenite at the annealing temperature is insufficient and/or the carbides existing prior to the annealing are not sufficiently dissolved, as a result of which prescribed structure and properties may not be obtained. A retention time of longer than 600 seconds presents no problem in terms of properties; however, since it requires a long equipment line, an upper limit is substantially about 600 seconds.

(Average Cooling Rate)

After the above-described annealing, cooling is preferably performed from 750° C. to 550° C. at an average cooling rate of 100.0° C./sec or lower. A lower limit value of the average cooling rate is not particularly restricted and may be, for example, 2.5° C./sec. The reason for setting the lower limit value of the average cooling rate at 2.5° C./sec is to inhibit the occurrence of ferrite transformation in the base steel sheet and thereby prevent the base steel sheet from being softened. When the average cooling rate is lower than 2.5° C./sec, the strength may be reduced. The average cooling rate is more preferably 5.0° C./sec or higher, still more preferably 10.0° C./sec or higher, yet still more preferably 20.0° C./sec or higher. At a temperature of higher than 750° C., the cooling rate is not restricted since ferrite transformation is unlikely to occur. At a temperature of lower than 550° C., the cooling rate is also not restricted since a low-temperature transformed structure is obtained. When the cooling is performed at a rate of higher than 100.0° C./sec, a low-temperature transformed structure is generated in the surface layer as well, and this causes a variation in hardness; therefore, the cooling is performed at a rate of preferably 100.0° C./sec or lower, more preferably 80.0° C./sec or lower, still more preferably 60.0° C./sec or lower.

(Cooling Stop Temperature)

The above-described cooling is stopped at a temperature of 25° C. to 550° C. (cooling stop temperature). Subsequently, when this cooling stop temperature is lower than (plating bath temperature−40° C.), the steel sheet may be reheated and retained in a temperature range of 350° C. to 550° C. When the cooling is performed in the above-described temperature range, martensite is generated from untransformed austenite during the cooling. By reheating the steel sheet thereafter, martensite is tempered, and precipitation of carbides as well as recovery and rearrangement of dislocations take place in the hard phase, as a result of which the hydrogen embrittlement resistance is improved. The reason why the lower limit of the cooling stop temperature is set at 25° C. is not only because excessive cooling requires a significant equipment investment, but also because the effects of the cooling are saturated.

(Retention Temperature)

After the reheating but before immersion in a plating bath, the steel sheet may be retained in a temperature range of 350 to 550° C. The retention in this temperature range not only contributes to tempering of martensite, but also eliminates temperature variation of the sheet in the width direction and improves the post-plating outer appearance. It is noted here that, when the cooling stop temperature is 350° C. to 550° C., the steel sheet may be retained as is without reheating.

(Retention Time)

The duration of the retention is desirably set at 10 seconds to 600 seconds so as to obtain the effects of the retention.

(Tempering)

In a series of annealing operations, the cold-rolled sheet, or the cold-rolled sheet on which a plating treatment has been performed, may be started to be reheated after being cooled to room temperature or in the middle of being cooled to room temperature (provided that the sheet temperature is not higher than the martensitic transformation start temperature (Ms)), and then retained in a temperature range of 150° C. to 400° C. for 2 seconds or longer. According to this step, by tempering martensite generated during the post-reheating cooling into tempered martensite, the hydrogen embrittlement resistance can be improved. When the tempering step is performed, with a retention temperature of lower than 150° C. or a retention time of shorter than 2 seconds, martensite is not sufficiently tempered, and satisfactory changes thus may not be attained in terms of microstructure and mechanical properties. On the other hand, a retention temperature of higher than 400° C. causes a reduction of the dislocation density in tempered martensite, as a result of which the tensile strength may be deteriorated. Therefore, when tempering is performed, it is preferred to retain the steel sheet in a temperature range of 150° C. to 400° C. for 2 seconds or longer. The tempering may be performed inside a continuous annealing equipment, or may be performed using a separate off-line equipment after the continuous annealing. In this process, the tempering time varies depending on the tempering temperature. In other words, the lower the tempering temperature, the longer is the tempering time, and the higher the tempering temperature, the shorter is the tempering time.

(Plating)

During or after the annealing step, as required, hot-dip galvanization may be performed on the cold-rolled steel sheet by heating or cooling the cold-rolled steel sheet to a temperature of (galvanizing bath temperature−40)° C. to (galvanizing bath temperature+50)° C. By this hot-dip galvanization step, a hot-dip galvanized layer is formed on at least one surface, preferably both surfaces of the cold-rolled steel sheet. In this case, the corrosion resistance of the cold-rolled steel sheet is improved, which is preferred. Even when hot-dip galvanization is performed, the hydrogen embrittlement resistance of the cold-rolled steel sheet can be maintained sufficiently.

For a plating treatment, for example, the Sendzimir method in which "after degreasing and pickling, a steel sheet is heated in a non-oxidizing atmosphere, annealed in a reducing atmosphere containing $H_2$ and $N_2$, subsequently cooled to the vicinity of the temperature of a plating bath, and then immersed in the plating bath", a total reduction furnace method in which "after the atmosphere during annealing is adjusted and a steel sheet surface is oxidized first, the steel sheet surface is reduced and thereby cleaned before being plated, and subsequently immersed in a plating bath", or a flux method in which "after degreasing and pickling of a steel sheet, the steel sheet is flux-treated with ammonium chloride and subsequently immersed in a plating bath" may be employed, and the effects of the present invention can be exerted under any of these treatment conditions.

(Plating Bath Temperature)

The plating bath temperature is preferably 450 to 490° C. When the plating bath temperature is lower than 450° C., the viscosity of the plating bath is excessively increased and this makes it difficult to control the thickness of the plated layer, as a result of which the outer appearance of the resulting hot-dip galvanized steel sheet may be deteriorated. On the other hand, when the plating bath temperature is higher than 490° C., a large amount of fume is generated, and this can make it difficult to safely perform the plating operations. The plating bath temperature is more preferably 455° C. or higher, but it is more preferably 480° C. or lower.

(Composition of Plating Bath)

As for the composition of the plating bath, the plating bath is preferably mainly composed of Zn and has an effective Al amount (a value obtained by subtracting a total Fe content from a total Al content in the plating bath) of 0.050 to 0.250% by mass. When the effective Al amount in the plating bath is less than 0.050% by mass, the plating adhesion may be deteriorated due to excessive diffusion of Fe into the plated layer. On the other hand, when the effective Al amount in the plating bath is greater than 0.250% by mass, Al-based oxides that inhibit the movement of Fe atoms and Zn atoms are generated at the interface between the steel sheet and the plated layer, as a result of which the plating adhesion may be deteriorated. The effective Al amount in the plating bath is more preferably 0.065% by mass or greater, but it is more preferably 0.180% by mass or less.

(Steel Sheet Temperature at Immersion in Plating Bath)

The plating bath immersion sheet temperature (the temperature of the steel sheet at the time of being immersed in a hot-dip galvanizing bath) is preferably in a range of 40° C. lower than the hot-dip galvanizing bath temperature ("hot-dip galvanizing bath temperature−40° C.") to 50° C. higher than the hot-dip galvanizing bath temperature ("hot-dip galvanizing bath temperature+50° C."). A plating bath immersion sheet temperature of lower than [hot-dip galvanizing bath temperature−40° C.] is not desirable since this may lead to deterioration of the plated outer appearance due to a large heat loss during the immersion in the plating bath and partial solidification of molten zinc. When the sheet temperature prior to the immersion is lower than [hot-dip galvanizing bath temperature−40° C.], the steel sheet may be further heated prior to the immersion in the plating bath by an arbitrary method so as to control the sheet temperature to be [hot-dip galvanizing bath temperature−40° C.] or higher, and the steel sheet may be immersed into the plating bath thereafter. Further, when the plating bath immersion sheet temperature is higher than [hot-dip galvanizing bath temperature+50° C.], an operational problem is induced in association with an increase in the plating bath temperature.

(Plating Pretreatment)

In order to further improve the plating adhesion, prior to the annealing in a continuous hot-dip galvanization line, the base steel sheet may be plated with one or more of Ni, Cu, Co, and Fe.

(Plating Post-treatment)

On the surface of the hot-dip galvanized steel sheet or alloyed hot-dip galvanized steel sheet, upper-layer plating and various treatments, such as a chromate treatment, a phosphate treatment, a lubricity improvement treatment and a weldability improvement treatment, may also be performed for the purpose of improving the coating properties and the weldability.

(Skin Pass Rolling)

In addition, skin pass rolling may be performed for the purpose of improving the ductility through correction of the steel sheet shape and introduction of mobile dislocations. In the skin pass rolling after the heat treatment, the rolling reduction ratio is preferably in a range of 0.1 to 1.5%. A lower limit thereof is set at 0.1% since a rolling reduction ratio of lower than 0.1% has a small effect and is difficult to control. The productivity is markedly deteriorated when the rolling reduction ratio is higher than 1.5%; therefore, an upper limit thereof is set at 1.5%. The skin pass may be performed in-line or off-line. Further, the skin pass of the target rolling reduction ratio may be performed at once, or may be performed in several separate operations.

The steel sheet according to the present invention can be obtained by the above-described production method. In the above, a mode in which the uniformity of microsegregation-concentrated parts in a slab is improved by controlling the rolling reduction ratio at 5% or higher in the casting step is described; however, it is also possible to improve the uniformity of microsegregation-concentrated parts by, for example, controlling the temperature of the slab in the casting step.

EXAMPLES

Examples of the present invention will now be described; however, the present invention is not restricted to the conditions of the below-described Examples. The present invention can adopt a variety of conditions without departing from the gist of the present invention, as long as the object of the present invention is achieved.

Example 1

Steels having the respective chemical compositions shown in Table 1 were each melted and continuously cast to produce a slab (steel piece), and the thus obtained slab was subsequently roll-reduced by 6% at a temperature of 800° C. to lower than 1,200° C. in a period after the continuous casting and before cooling of the slab to room temperature, whereby a slab in which the uniformity of microsegregation-concentrated parts was improved (the concentration difference of element-concentrated parts was reduced) was produced. This slab was inserted to a furnace heated to 1,220° C. and retained therein for 60 minutes to perform a homogenization treatment, after which the slab was taken out to the atmosphere and then hot-rolled to obtain a steel sheet having a thickness of 2.8 mm. In this hot rolling, the finish-rolling termination temperature (finishing temperature) was 920° C. and, after a lapse of 1.5 seconds from the termination of the finish rolling, the steel sheet was water-cooled to a coiling temperature of 610° C. at a rate of 28° C./sec, and then retained at 660° C. for 1 hour to perform a reheating treatment. Subsequently, oxide scales on the thus obtained hot-rolled steel sheet were removed by pickling, and the hot-rolled steel sheet was cold-rolled at a rolling reduction ratio of 50.0% to attain a thickness of 1.4 mm. Further, this cold-rolled steel sheet was heated to 790° C. at a rate of 8.0° C./sec and retained at 790° C. for 105 seconds, after which the steel sheet was cooled to 480° C. at an average cooling rate of 4.0° C./sec and subsequently retained at 460° C. for 12 seconds to perform cold-rolled sheet annealing. Thereafter, the steel sheet was further skin-pass rolled such that the resulting steel strip had an elongation of 0.3%. Table 2 shows the results of evaluating the properties of each steel sheet on which the above-described thermo-mechanical treatments were performed. It is noted here that the remainder other than the components shown in Table 1 was composed of Fe and impurities. The chemical composition analyzed for a sample collected from each of the thus produced steel sheets was the same as the chemical composition of the corresponding steel shown in Table 1.

(Method of Evaluating Tensile Properties)

The tensile strength (TS) and the total elongation (El) were measured by performing a tensile test in accordance with JIS Z2241(2011) for a JIS No. 5 test piece that was collected such that the longitudinal direction of the test piece was aligned parallel to the direction perpendicular to the rolling direction of a steel strip.

(Method of Evaluating Stretch Formability)

The stretch formability was evaluated by performing the following spherical stretch forming test.

Sample drawing width: 200 mm×200 mm

Mold: a spherical punch of 60 mm in radius, beaded die

Pressing load: 60 t

Bulging rate: 30 mm/min

Lubrication: application of anti-rust oil

For a steel sheet on which a stretching process was performed to a height of 25 mm under the above-described conditions, the bulging height of the outer surface of the spherically stretched steel sheet was measured along a circumferential shape at a position of 25 mm away from the center axis of the spherical punch using a laser or LED noncontact-type displacement meter. A passing grade (○) was given when the difference between the maximum bulging height and the minimum bulging height was 3 mm or less, while a failing grade (x) was given when this difference in height was larger than 3 mm.

A steel sheet was evaluated to have a high strength and excellent stretch formability when the tensile strength was 550 to 1,100 MPa and the evaluation of the stretch formability was "○".

TABLE 1-1

| No. | C | Si | Mn | P | S | Al | N | Co | Ni | Mo | Cr | O | Ti | B | Nb |
|---|---|---|---|---|---|---|---|---|---|---|---|---|---|---|---|
| A | 0.10 | 0.23 | 2.73 | 0.0012 | 0.0010 | 0.104 | 0.0164 | 0.0380 | 0.0404 | 0.4190 | 0.1036 | 0.0042 | 0.0274 | 0.0011 | 0.0265 |
| B | 0.16 | 1.11 | 2.14 | 0.0015 | 0.0033 | 0.072 | 0.0014 | 0.0417 | 0.1149 | 0.3876 | 0.0467 | 0.0079 | 0.3734 | 0.0009 | 0.4319 |
| C | 0.15 | 0.50 | 2.01 | 0.0030 | 0.0172 | 0.121 | 0.0018 | 0.0456 | 0.4100 | 0.0412 | 0.7489 | 0.0023 | 0.0450 | 0.0012 | 0.0651 |
| D | 0.13 | 0.72 | 2.31 | 0.0163 | 0.0020 | 0.041 | 0.0011 | 0.0493 | 0.0543 | 0.0460 | 0.1023 | 0.0009 | 0.4233 | 0.0009 | 0.3895 |
| E | 0.08 | 0.45 | 2.01 | 0.0091 | 0.0032 | 0.032 | 0.0029 | — | — | — | — | — | — | — | — |
| F | 0.11 | 0.10 | 1.39 | 0.0021 | 0.0021 | 0.078 | 0.0015 | 0.0496 | 0.0236 | 0.0592 | 0.0804 | 0.0017 | 0.0795 | 0.0075 | 0.3169 |
| G | 0.09 | 0.45 | 2.58 | 0.0103 | 0.0038 | 0.021 | 0.0023 | — | — | — | — | — | — | — | — |
| H | 0.19 | 0.59 | 1.87 | 0.0125 | 0.0019 | 0.076 | 0.0014 | 0.0708 | 0.0334 | 0.3107 | 0.0420 | 0.0020 | 0.0489 | 0.0061 | 0.2022 |
| I | 0.13 | 0.38 | 1.90 | 0.0020 | 0.0129 | 0.141 | 0.0012 | 0.3751 | 0.0333 | 0.0393 | 0.2383 | 0.0012 | 0.0901 | 0.0009 | 0.1212 |
| J | 0.18 | 0.36 | 2.51 | 0.0025 | 0.0020 | 0.086 | 0.0074 | 0.0542 | 0.0876 | 0.0391 | 0.1055 | 0.0169 | 0.3238 | 0.0041 | 0.0356 |
| K | 0.12 | 0.78 | 1.38 | 0.0013 | 0.0030 | 0.060 | 0.0015 | — | — | — | — | — | — | — | — |
| L | 0.19 | 0.81 | 2.80 | 0.0011 | 0.0019 | 0.127 | 0.0031 | — | — | — | — | — | — | — | — |
| M | 0.06 | 0.95 | 1.66 | 0.0034 | 0.0153 | 0.769 | 0.0016 | 0.3032 | 0.0235 | 0.0232 | 0.1936 | 0.0025 | 0.0671 | 0.0010 | 0.0377 |
| N | 0.07 | 0.11 | 2.24 | 0.0118 | 0.0043 | 0.613 | 0.0041 | — | — | — | — | — | — | — | — |
| O | 0.14 | 1.15 | 1.04 | 0.0009 | 0.0074 | 0.250 | 0.0046 | 0.1116 | 0.2078 | 0.1238 | 0.1324 | 0.0126 | 0.0531 | 0.0082 | 0.0702 |
| P | 0.07 | 1.07 | 2.38 | 0.0017 | 0.0015 | 0.813 | 0.0018 | 0.1800 | 0.0794 | 0.2034 | 0.0962 | 0.0034 | 0.0307 | 0.0011 | 0.0408 |
| Q | 0.09 | 1.23 | 1.71 | 0.0152 | 0.0053 | 0.098 | 0.0155 | — | — | — | — | — | — | — | — |
| R | 0.17 | 0.09 | 2.92 | 0.0014 | 0.0009 | 0.610 | 0.0020 | 0.4155 | 0.0440 | 0.0852 | 0.6283 | 0.0017 | 0.0482 | 0.0007 | 0.0394 |
| S | **0.04** | 0.33 | 1.09 | 0.0016 | 0.0021 | 0.087 | 0.0020 | — | — | — | — | — | — | — | — |
| T | **0.21** | 0.63 | 2.90 | 0.0040 | 0.0023 | 0.054 | 0.0164 | — | — | — | — | — | — | — | — |
| U | 0.13 | **1.35** | 2.57 | 0.0034 | 0.0137 | 0.056 | 0.0173 | — | — | — | — | — | — | — | — |
| V | 0.09 | 1.07 | **0.93** | 0.0039 | 0.0144 | 0.061 | 0.0014 | — | — | — | — | — | — | — | — |
| W | 0.11 | 0.26 | **3.06** | 0.0163 | 0.0024 | 0.116 | 0.0020 | — | — | — | — | — | — | — | — |
| X | 0.13 | 0.15 | 1.16 | **0.0206** | 0.0016 | 0.777 | 0.0008 | — | — | — | — | — | — | — | — |

*Bold and underlined values are outside the scope of the present invention.

TABLE 1-2

| No. | C | Si | Mn | P | s | Al | N | Co | Ni | Mo | Cr | O | Ti | B | Nb |
|---|---|---|---|---|---|---|---|---|---|---|---|---|---|---|---|
| Y | 0.10 | 0.22 | 1.54 | 0.0012 | **0.0205** | 0.144 | 0.0020 | 0.3324 | 0.0506 | 0.1718 | 0.6617 | 0.0030 | 0.3446 | 0.0010 | 0.0503 |
| Z | 0.12 | 0.21 | 2.69 | 0.0020 | 0.0091 | **1.038** | 0.0018 | — | — | — | — | — | — | — | — |
| AA | 0.06 | 0.69 | 1.80 | 0.0134 | 0.0053 | 0.052 | **0.0207** | 0.0402 | 0.0386 | 0.0615 | 0.0687 | 0.0010 | 0.4016 | 0.0016 | 0.0262 |
| AB | 0.14 | 0.69 | 1.36 | 0.0018 | 0.0014 | 0.106 | 0.0013 | **0.5102** | 0.1532 | 0.1044 | 0.8161 | 0.0019 | 0.0692 | 0.0024 | 0.0214 |
| AC | 0.18 | 0.84 | 1.89 | 0.0027 | 0.0073 | 0.301 | 0.0012 | 0.3917 | **0.5168** | 0.0595 | 0.0457 | 0.0018 | 0.1047 | 0.0007 | 0.0424 |
| AD | 0.16 | 1.14 | 2.19 | 0.0153 | 0.0010 | 0.116 | 0.0024 | 0.0518 | 0.0906 | **0.5153** | 0.3512 | 0.0016 | 0.0359 | 0.0012 | 0.0276 |
| AE | 0.11 | 0.40 | 2.86 | 0.0140 | 0.0031 | 0.836 | 0.0165 | 0.3616 | 0.0627 | 0.0223 | **1.0306** | 0.0042 | 0.0454 | 0.0011 | 0.0511 |
| AF | 0.06 | 0.89 | 2.87 | 0.0017 | 0.0016 | 0.166 | 0.0028 | 0.3095 | 0.0520 | 0.0345 | 0.1101 | **0.0206** | 0.0437 | 0.0012 | 0.0488 |
| AG | 0.13 | 0.41 | 1.84 | 0.0021 | 0.0014 | 0.151 | 0.0018 | 0.2737 | 0.3965 | 0.3658 | 0.0590 | 0.0019 | **0.5168** | 0.0010 | 0.0394 |
| AH | 0.18 | 0.88 | 1.99 | 0.0104 | 0.0011 | 0.050 | 0.0124 | 0.0290 | 0.0309 | 0.0557 | 0.1003 | 0.0010 | 0.0287 | **0.0102** | 0.3065 |
| AI | 0.12 | 1.07 | 1.58 | 0.0011 | 0.0023 | 0.089 | 0.0015 | 0.0574 | 0.0245 | 0.0368 | 0.0828 | 0.0025 | 0.0481 | 0.0012 | **0.5162** |
| AJ | 0.17 | 0.34 | 1.90 | 0.0056 | 0.0108 | 0.735 | 0.0023 | 0.0361 | 0.0414 | 0.0298 | 0.0347 | 0.0012 | 0.0498 | 0.0008 | 0.4162 |
| AK | 0.15 | 1.02 | 2.17 | 0.0012 | 0.0013 | 0.065 | 0.0019 | 0.0346 | 0.0265 | 0.3168 | 0.0353 | 0.0164 | 0.2737 | 0.0055 | 0.0373 |
| AL | 0.09 | 0.77 | 1.41 | 0.0092 | 0.0014 | 0.189 | 0.0068 | 0.0292 | 0.4040 | 0.0816 | 0.0900 | 0.0008 | 0.0323 | 0.0013 | 0.0411 |
| AM | 0.16 | 0.15 | 2.27 | 0.0012 | 0.0057 | 0.177 | 0.0017 | 0.1965 | 0.0378 | 0.0683 | 0.1296 | 0.0013 | 0.0255 | 0.0010 | 0.0529 |
| AN | 0.19 | 0.52 | 2.72 | 0.0023 | 0.0146 | 0.104 | 0.0147 | 0.0553 | 0.0970 | 0.0589 | 0.1131 | 0.0020 | 0.0213 | 0.0025 | 0.0646 |
| AO | 0.18 | 0.43 | 1.86 | 0.0015 | 0.0018 | 0.176 | 0.0020 | 0.0352 | 0.3635 | 0.1409 | 0.7894 | 0.0026 | 0.2141 | 0.0009 | 0.1646 |
| AP | 0.14 | 1.18 | 2.38 | 0.0014 | 0.0065 | 0.248 | 0.0009 | 0.1326 | 0.0298 | 0.0320 | 0.0450 | 0.0017 | 0.0308 | 0.0012 | 0.0618 |

TABLE 1-2-continued

| No. | C | Si | Mn | P | s | Al | N | Co | Ni | Mo | Cr | O | Ti | B | Nb |
|---|---|---|---|---|---|---|---|---|---|---|---|---|---|---|---|
| AQ | 0.07 | 0.49 | 1.39 | 0.0009 | 0.0012 | 0.529 | 0.0054 | 0.0448 | 0.2735 | 0.0714 | 0.0543 | 0.0011 | 0.0256 | 0.0072 | 0.0265 |
| AR | 0.12 | 0.28 | 2.02 | 0.0010 | 0.0023 | 0.116 | 0.0019 | 0.0356 | 0.0886 | 0.0769 | 0.0631 | 0.0022 | 0.0275 | 0.0079 | 0.2734 |
| AS | 0.06 | 0.55 | 2.66 | 0.0031 | 0.0034 | 0.092 | 0.0010 | 0.0661 | 0.0500 | 0.0342 | 0.0752 | 0.0014 | 0.0449 | 0.0006 | 0.0384 |
| AT | 0.06 | 0.53 | 1.25 | 0.0147 | 0.0048 | 0.146 | 0.0013 | 0.0304 | 0.3045 | 0.2300 | 0.1038 | 0.0014 | 0.0567 | 0.0031 | 0.0300 |
| AU | 0.07 | 1.11 | 2.04 | 0.0114 | 0.0020 | 0.084 | 0.0017 | 0.4196 | 0.0236 | 0.3852 | 0.1078 | 0.0014 | 0.0190 | 0.0007 | 0.0392 |
| AV | 0.20 | 1.01 | 2.53 | 0.0011 | 0.0017 | 0.155 | 0.0076 | 0.0588 | 0.0558 | 0.4262 | 0.1542 | 0.0027 | 0.0448 | 0.0005 | 0.1713 |
| AW | 0.11 | 0.65 | 2.49 | 0.0081 | 0.0022 | 0.028 | 0.0034 | — | — | 0.0503 | 0.5112 | 0.0012 | 0.0213 | 0.0021 | 0.0108 |

*Bold and underlined values are outside the scope of the present invention.

TABLE 1-3

| No. | V | Cu | W | Ta | Sn | Sb | As | Mg | Ca | Y | Zr | La | Ce | Note |
|---|---|---|---|---|---|---|---|---|---|---|---|---|---|---|
| A | 0.1842 | 0.0197 | 0.0116 | 0.0101 | 0.0039 | 0.0054 | 0.0048 | 0.0054 | 0.0026 | 0.0054 | 0.0116 | 0.0208 | 0.0421 | developed steel |
| B | 0.0187 | 0.0500 | 0.0052 | 0.0080 | 0.0393 | 0.0069 | 0.0315 | 0.0042 | 0.0409 | 0.0046 | 0.0051 | 0.0032 | 0.0027 | developed steel |
| C | 0.1030 | 0.1234 | 0.0074 | 0.0080 | 0.0046 | 0.0198 | 0.0053 | 0.0057 | 0.0117 | 0.0041 | 0.0307 | 0.0027 | 0.0043 | developed steel |
| D | 0.0304 | 0.0260 | 0.0802 | 0.0063 | 0.0034 | 0.0304 | 0.0086 | 0.0050 | 0.0021 | 0.0050 | 0.0043 | 0.0397 | 0.0394 | developed steel |
| E | — | — | — | — | — | — | — | — | — | — | — | — | — | developed steel |
| F | 0.0376 | 0.0377 | 0.0056 | 0.0093 | 0.0041 | 0.0046 | 0.0382 | 0.0038 | 0.0189 | 0.0063 | 0.0193 | 0.0026 | 0.0031 | developed steel |
| G | — | — | — | — | — | — | — | — | — | — | — | — | — | developed steel |
| H | 0.0486 | 0.4274 | 0.0097 | 0.0825 | 0.0068 | 0.0388 | 0.0030 | 0.0057 | 0.0056 | 0.0018 | 0.0037 | 0.0110 | 0.0033 | developed steel |
| I | 0.4001 | 0.0561 | 0.0858 | 0.0786 | 0.0414 | 0.0038 | 0.0026 | 0.0069 | 0.0401 | 0.0081 | 0.0072 | 0.0052 | 0.0041 | developed steel |
| J | 0.0687 | 0.3056 | 0.0041 | 0.0089 | 0.0039 | 0.0043 | 0.0046 | 0.0040 | 0.0039 | 0.0108 | 0.0028 | 0.0055 | 0.0044 | developed steel |
| K | — | — | — | — | — | — | — | — | — | — | — | — | — | developed steel |
| L | — | — | — | — | — | — | — | — | — | — | — | — | — | developed steel |
| M | 0.0220 | 0.0384 | 0.0086 | 0.0095 | 0.0070 | 0.0040 | 0.0045 | 0.0133 | 0.0097 | 0.0199 | 0.0043 | 0.0032 | 0.0055 | developed steel |
| N | — | — | — | — | — | — | — | — | — | — | — | — | — | developed steel |
| O | 0.0630 | 0.0251 | 0.0103 | 0.0054 | 0.0049 | 0.0044 | 0.0045 | 0.0307 | 0.0050 | 0.0021 | 0.0058 | 0.0025 | 0.0023 | developed steel |
| P | 0.3300 | 0.0430 | 0.0059 | 0.0113 | 0.0311 | 0.0082 | 0.0067 | 0.0080 | 0.0043 | 0.0428 | 0.0056 | 0.0068 | 0.0118 | developed steel |
| Q | — | — | — | — | — | — | — | — | — | — | — | — | — | developed steel |
| R | 0.0333 | 0.3815 | 0.0227 | 0.0121 | 0.0208 | 0.0019 | 0.0049 | 0.0429 | 0.0020 | 0.0031 | 0.0027 | 0.0039 | 0.0181 | developed steel |
| S | — | — | — | — | — | — | — | — | — | — | — | — | — | comparative steel |
| T | — | — | — | — | — | — | — | — | — | — | — | — | — | comparative steel |
| U | — | — | — | — | — | — | — | — | — | — | — | — | — | comparative steel |
| V | — | — | — | — | — | — | — | — | — | — | — | — | — | comparative steel |
| W | — | — | — | — | — | — | — | — | — | — | — | — | — | comparative steel |
| X | — | — | — | — | — | — | — | — | — | — | — | — | — | comparative steel |

*Bold and underlined values are outside the scope of the present invention.

TABLE 1-4

| No. | V | Cu | W | Ta | Sn | Sb | As | Mg | Ca | Y | Zr | La | Ce | Note |
|---|---|---|---|---|---|---|---|---|---|---|---|---|---|---|
| Y | 0.0607 | 0.2154 | 0.0497 | 0.0810 | 0.0043 | 0.0041 | 0.0363 | 0.0033 | 0.0042 | 0.0048 | 0.0329 | 0.0082 | 0.0080 | comparative steel |
| Z | — | — | — | — | — | — | — | — | — | — | — | — | — | comparative steel |
| AA | 0.0497 | 0.0377 | 0.0060 | 0.0284 | 0.0104 | 0.0060 | 0.0041 | 0.0063 | 0.0082 | 0.0404 | 0.0109 | 0.0375 | 0.0256 | comparative steel |
| AB | 0.4086 | 0.1029 | 0.0068 | 0.0738 | 0.0059 | 0.0075 | 0.0419 | 0.0035 | 0.0368 | 0.0042 | 0.0056 | 0.0091 | 0.0030 | comparative steel |
| AC | 0.0368 | 0.0320 | 0.0132 | 0.0064 | 0.0027 | 0.0058 | 0.0033 | 0.0365 | 0.0231 | 0.0392 | 0.0106 | 0.0025 | 0.0091 | comparative steel |
| AD | 0.0580 | 0.0529 | 0.0070 | 0.0088 | 0.0362 | 0.0377 | 0.0037 | 0.0043 | 0.0042 | 0.0224 | 0.0067 | 0.0071 | 0.0043 | comparative steel |
| AE | 0.0443 | 0.0418 | 0.0072 | 0.0057 | 0.0036 | 0.0032 | 0.0334 | 0.0062 | 0.0050 | 0.0063 | 0.0100 | 0.0114 | 0.0050 | comparative steel |
| AF | 0.0437 | 0.1359 | 0.0061 | 0.0106 | 0.0046 | 0.0080 | 0.0250 | 0.0403 | 0.0025 | 0.0052 | 0.0051 | 0.0077 | 0.0046 | comparative steel |
| AG | 0.1018 | 0.0379 | 0.0070 | 0.0090 | 0.0269 | 0.0068 | 0.0037 | 0.0046 | 0.0155 | 0.0050 | 0.0414 | 0.0043 | 0.0072 | comparative steel |
| AH | 0.0353 | 0.0704 | 0.0161 | 0.0068 | 0.0039 | 0.0032 | 0.0306 | 0.0025 | 0.0425 | 0.0061 | 0.0166 | 0.0032 | 0.0139 | comparative steel |
| AI | 0.0953 | 0.0520 | 0.0232 | 0.0155 | 0.0041 | 0.0025 | 0.0080 | 0.0028 | 0.0052 | 0.0183 | 0.0044 | 0.0142 | 0.0029 | comparative steel |
| AJ | **0.5123** | 0.0518 | 0.0105 | 0.0060 | 0.0125 | 0.0361 | 0.0142 | 0.0028 | 0.0052 | 0.0040 | 0.0050 | 0.0031 | 0.0047 | comparative steel |
| AK | 0.0758 | **0.5128** | 0.0428 | 0.0038 | 0.0304 | 0.0052 | 0.0022 | 0.0146 | 0.0030 | 0.0043 | 0.0023 | 0.0132 | 0.0428 | comparative steel |
| AL | 0.0249 | 0.0480 | **0.1022** | 0.0802 | 0.0406 | 0.0049 | 0.0050 | 0.0047 | 0.0032 | 0.0040 | 0.0218 | 0.0028 | 0.0023 | comparative steel |
| AM | 0.0295 | 0.0524 | 0.0731 | **0.1034** | 0.0041 | 0.0260 | 0.0041 | 0.0216 | 0.0104 | 0.0052 | 0.0026 | 0.0044 | 0.0037 | comparative steel |
| AN | 0.0383 | 0.0191 | 0.0257 | 0.0094 | **0.0516** | 0.0170 | 0.0033 | 0.0070 | 0.0377 | 0.0032 | 0.0039 | 0.0026 | 0.0069 | comparative steel |
| AO | 0.2713 | 0.3775 | 0.0084 | 0.0049 | 0.0025 | **0.0519** | 0.0086 | 0.0034 | 0.0050 | 0.0345 | 0.0391 | 0.0035 | 0.0034 | comparative steel |
| AP | 0.0358 | 0.0613 | 0.0034 | 0.0117 | 0.0048 | 0.0392 | **0.0515** | 0.0037 | 0.0028 | 0.0025 | 0.0194 | 0.0210 | 0.0061 | comparative steel |
| AQ | 0.4039 | 0.2615 | 0.0053 | 0.0074 | 0.0060 | 0.0123 | 0.0190 | **0.0510** | 0.0401 | 0.0044 | 0.0040 | 0.0065 | 0.0026 | comparative steel |
| AR | 0.0405 | 0.0822 | 0.0054 | 0.0060 | 0.0054 | 0.0432 | 0.0396 | 0.0037 | **0.0518** | 0.0108 | 0.0053 | 0.0028 | 0.0044 | comparative steel |
| AS | 0.1617 | 0.0326 | 0.0084 | 0.0042 | 0.0365 | 0.0066 | 0.0018 | 0.0039 | 0.0051 | **0.0517** | 0.0382 | 0.0030 | 0.0042 | comparative steel |
| AT | 0.0368 | 0.0332 | 0.0380 | 0.0452 | 0.0076 | 0.0024 | 0.0041 | 0.0049 | 0.0114 | 0.0039 | **0.0513** | 0.0024 | 0.0043 | comparative steel |
| AU | 0.0430 | 0.0742 | 0.0111 | 0.0103 | 0.0056 | 0.0023 | 0.0057 | 0.0103 | 0.0038 | 0.0118 | 0.0028 | **0.0519** | 0.0057 | comparative steel |

TABLE 1-4-continued

| No. | V | Cu | W | Ta | Sn | Sb | As | Mg | Ca | Y | Zr | La | Ce | Note |
|---|---|---|---|---|---|---|---|---|---|---|---|---|---|---|
| AV | 0.3857 | 0.0309 | 0.0105 | 0.0115 | 0.0048 | 0.0023 | 0.0026 | 0.0026 | 0.0041 | 0.0027 | 0.0047 | 0.0052 | **0.0511** | comparative steel |
| AW | — | — | — | — | — | — | — | — | — | — | — | — | — | developed steel |

*Bold and underlined values are outside the scope of the present invention.

TABLE 2-1

| No. | Total of ferrite and bainite (%) | Total of martensite and tempered martensite (%) | Total of pearlite and retained austenite (%) | Integration degree of (111)<112> orientation of ferrite | Integration degree of (252)<2-11> orientation of martensite and tempered martensite | Tensile strength (MPa) | Total elongation (%) | Stretch formability | Note |
|---|---|---|---|---|---|---|---|---|---|
| A-1 | 41.9 | 57.1 | 1.0 | 3.8 | 0.6 | 996 | 15.2 | ○ | Example |
| B-1 | 43.9 | 55.0 | 1.1 | 5.2 | 0.3 | 1,098 | 13.5 | ○ | Example |
| C-1 | 50.8 | 48.0 | 1.2 | 4.8 | 2.4 | 1,045 | 14.6 | ○ | Example |
| D-1 | 53.8 | 44.3 | 1.9 | 5.4 | 2.9 | 1,030 | 14.8 | ○ | Example |
| E-1 | 89.2 | 6.0 | 4.8 | 3.9 | 1.2 | 594 | 29.4 | ○ | Example |
| F-1 | 83.3 | 6.3 | 10.4 | 5.9 | 1.5 | 623 | 27.3 | ○ | Example |
| G-1 | 50.2 | 48.2 | 1.6 | 5.1 | 0.4 | 988 | 15.5 | ○ | Example |
| H-1 | 49.5 | 49.0 | 1.5 | 5.9 | 0.5 | 1,071 | 14.2 | ○ | Example |
| I-1 | 68.2 | 28.2 | 3.6 | 4.3 | 2.6 | 903 | 16.8 | ○ | Example |
| J-1 | 40.0 | 58.3 | 1.7 | 4.8 | 4.8 | 1,023 | 14.9 | ○ | Example |
| K-1 | 76.3 | 18.9 | 4.8 | 4.7 | 2.2 | 899 | 17.2 | ○ | Example |
| L-1 | 39.3 | 59.6 | 1.1 | 4.9 | 1.1 | 1,079 | 14.2 | ○ | Example |
| M-1 | 87.2 | 10.5 | 2.3 | 5.6 | 4.5 | 895 | 17.1 | ○ | Example |
| N-1 | 70.3 | 27.0 | 2.7 | 3.3 | 0.3 | 786 | 19.7 | ○ | Example |
| O-1 | 76.0 | 20.8 | 3.2 | 3.2 | 2.1 | 1,011 | 14.9 | ○ | Example |
| P-1 | 75.0 | 24.0 | 1.0 | 5.4 | 1.1 | 1,032 | 14.7 | ○ | Example |
| Q-1 | 75.9 | 21.6 | 2.5 | 3.5 | 4.3 | 991 | 15.0 | ○ | Example |
| R-1 | 48.0 | 51.0 | 1.0 | 4.3 | 1.2 | 1,035 | 14.6 | ○ | Example |
| S-1 | 89.2 | 7.2 | 3.6 | 3.7 | **5.6** | 632 | 24.1 | **x** | Comparative Example |
| T-1 | 22.6 | 76.4 | 1.0 | **2.4** | 2.2 | 896 | 14.1 | **x** | Comparative Example |
| U-1 | 42.9 | 56.1 | 1.0 | 3.5 | 0.6 | **1,164** | 11.8 | **x** | Comparative Example |
| V-1 | 80.2 | **4.1** | **15.7** | 5.5 | 4.9 | **488** | 12.7 | ○ | Comparative Example |
| W-1 | **7.2** | 79.6 | 13.2 | 5.0 | 2.2 | 1,077 | 13.5 | **x** | Comparative Example |
| X-1 | 82.1 | 10.1 | 7.8 | 5.1 | 4.8 | 723 | 21.9 | **x** | Comparative Example |

*Bold and underlined values are outside the scope of the present invention.

TABLE 2-2

| No. | Total of ferrite and bainite (%) | Total of martensite and tempered martensite (%) | Total of pearlite and retained austenite (%) | Integration degree of (111)<112> orientation of ferrite | Integration degree of (252)<2-11> orientation of martensite and tempered martensite | Tensile strength (MPa) | Total elongation (%) | Stretch formability | Note |
|---|---|---|---|---|---|---|---|---|---|
| Y-1 | 68.9 | 28.4 | 2.7 | 5.5 | 2.1 | 848 | 18.1 | **x** | Comparative Example |
| Z-1 | **91.6** | 7.3 | 1.1 | 5.2 | 3.7 | **538** | 21.2 | ○ | Comparative Example |
| AA-1 | 81.8 | 14.2 | 4.0 | 3.2 | 4.1 | 800 | 19.4 | **x** | Comparative Example |
| AB-1 | 65.1 | 33.1 | 1.8 | 3.2 | 1.1 | 1,001 | 15.1 | **x** | Comparative Example |
| AC-1 | 58.0 | 40.5 | 1.5 | 4.2 | 3.8 | 1,098 | 13.8 | **x** | Comparative Example |
| AD-1 | 11.2 | **87.8** | 1.0 | 5.3 | 2.3 | **1,116** | 10.4 | **x** | Comparative Example |
| AE-1 | 10.8 | 72.9 | **16.3** | 4.3 | 4.9 | 980 | 19.3 | **x** | Comparative Example |
| AF-1 | 59.1 | 39.8 | 1.1 | 5.1 | 0.3 | 1,000 | 13.2 | **x** | Comparative Example |
| AG-1 | 50.4 | 48.1 | 1.5 | 3.6 | 3.2 | 1,007 | 12.3 | **x** | Comparative Example |

TABLE 2-2-continued

| No. | Total of ferrite and bainite (%) | Total of martensite and tempered martensite (%) | Total of pearlite and retained austenite (%) | Integration degree of (111)<112> orientation of ferrite | Integration degree of (252)<2-11> orientation of martensite and tempered martensite | Tensile strength (MPa) | Total elongation (%) | Stretch formability | Note |
|---|---|---|---|---|---|---|---|---|---|
| AH-1 | 55.9 | 42.1 | 2.0 | 5.6 | 0.2 | 1,095 | 11.4 | x | Comparative Example |
| AI-1 | 75.2 | 20.9 | 3.9 | 5.7 | 3.7 | 988 | 14.6 | x | Comparative Example |
| AJ-1 | 69.5 | 28.5 | 2.0 | 4.9 | 4.2 | 981 | 13.8 | x | Comparative Example |
| AK-1 | 47.7 | 51.2 | 1.1 | 3.2 | 0.3 | **1,117** | 12.8 | x | Comparative Example |
| AL-1 | 80.9 | 14.8 | 4.3 | 4.5 | 3.4 | 842 | 16.9 | x | Comparative Example |
| AM-1 | 55.8 | 41.9 | 2.3 | 3.6 | 1.1 | 957 | 13.4 | x | Comparative Example |
| AN-1 | 37.4 | 61.4 | 1.2 | 3.7 | 4.3 | 1,034 | **8.9** | x | Comparative Example |
| AO-1 | 43.8 | 55.0 | 1.2 | 3.1 | 1.1 | 1,040 | **9.2** | x | Comparative Example |
| AP-1 | 59.2 | 39.6 | 1.2 | 5.2 | 1.3 | 1,089 | **8.1** | x | Comparative Example |
| AQ-1 | 87.8 | 7.0 | 5.2 | 4.4 | 1.5 | 731 | 11.4 | x | Comparative Example |
| AR-1 | 68.8 | 27.7 | 3.5 | 4.1 | 2.5 | 867 | 10.6 | x | Comparative Example |
| AS-1 | 64.4 | 34.2 | 1.4 | 3.7 | 3.6 | 921 | 12.2 | x | Comparative Example |
| AT-1 | 85.9 | 9.9 | 4.2 | 4.0 | 3.7 | 717 | 11.5 | x | Comparative Example |
| AU-1 | 64.1 | 34.8 | 1.1 | 5.8 | 1.4 | 1,032 | **6.3** | x | Comparative Example |
| AV-1 | 40.1 | 58.9 | 1.0 | 5.4 | 4.7 | **1,106** | **7.8** | x | Comparative Example |
| AW-1 | 23.4 | 76.6 | 0.0 | 5.2 | 3.8 | 1,078 | 13.1 | ○ | Example |

*Bold and underlined values are outside the scope of the present invention.

Referring to Table 2, in Example S-1, the orientation integration degree of martensite was not randomized due to the low C content, and the integration degree of the (252) <2-11> orientation of martensite and tempered martensite was thus higher than 5.0. As a result, the stretch formability was deteriorated. In Example T-1, since the orientation integration degree of ferrite was reduced due to the high C content, the stretch formability was deteriorated. In Example U-1, due to the high Si content, the tensile strength was increased to cause embrittlement, and the stretch formability was deteriorated. In Example V-1, the tensile strength was reduced due to the low Mn content. In Example W-1, since ferrite transformation and bainite transformation were inhibited due to the high Mn content, the stretch formability was deteriorated. In Example X-1, due to the high P content, the steel sheet was embrittled and the stretch formability was deteriorated. In Example Y-1, due to the high S content, cracking occurred during cold forming, and the stretch formability was deteriorated. In Example Z-1, since ferrite transformation and bainite transformation were excessively facilitated due to the high Al content, the tensile strength was reduced. In Example AA-1, due to the high N content, coarse nitrides were formed in the steel sheet, and the stretch formability was deteriorated.

In Example AB-1, a large amount of fine Co carbides precipitated due to the high Co content, and the stretch formability was deteriorated. In Example AC-1, the stretch formability was deteriorated due to the high Ni content. In Example AD-1, since martensitic transformation was facilitated due to the high Mo content, the stretch formability was deteriorated. In Example AE-1, a large amount of retained austenite was generated due to the high Cr content, and the stretch formability was deteriorated. In Example AF-1, oxides were formed due to the high 0 content, and the stretch formability was deteriorated. In Example AG-1, precipitation of carbonitride was increased due to the high Ti content, and the stretch formability was deteriorated. In Example AH-1, since coarse B oxides were generated in the steel due to the high B content, the stretch formability was deteriorated. In Example AI-1, Nb carbide precipitated in a large amount due to the high Nb content, and the stretch formability was deteriorated. In Example AJ-1, a large amount of carbonitride precipitated due to the high V content, and the stretch formability was deteriorated.

In Example AK-1, the tensile strength was excessively high due to the high Cu content, and the stretch formability was deteriorated in association therewith. In Example AL-1, the stretch formability was deteriorated due to the high W content. In Example AM-1, a large amount of fine Ta carbide precipitated due to the high Ta content, and the stretch formability was deteriorated. In Example AN-1, embrittlement of ferrite occurred due to the high Sn content, and the stretch formability was thereby deteriorated. In Examples AO-1 and AP-1, grain boundary segregation occurred due to the high Sb content and the high As content, respectively, and the stretch formability was thereby deteriorated. In Example AQ-1, coarse inclusions were formed due to the high Mg content, and the stretch formability was thereby deteriorated. In Example AR-1, the stretch formability was deteriorated due to the high Ca content. In Examples AS-1 to AV-1, coarse oxides were generated due to the high content of Y, Zr, La and Ce, respectively, and the stretch formability was deteriorated.

In contrast to the above, in Examples A-1 to R-1, steel sheets having a high strength and excellent stretch formability were obtained by appropriately controlling the chemical composition and the structure of each steel sheet as well as the integration degrees of ferrite and martensite.

Example 2

Further, in order to investigate the effects of the production conditions, hot-rolled steel sheets of 2.3 mm in thickness were produced by performing thermo-mechanical treatments in accordance with the production conditions shown in Table 3 on the respective steel species A to R that had been confirmed to have excellent properties as shown in Table 2, and the properties of these steel sheets were evaluated after cold rolling and annealing. The symbols GI and GA under "Plating treatment" each indicate a method of galvanization treatment. The symbol GI represents a steel sheet which was immersed in a 460° C. hot-dip galvanizing bath and thereby provided with a galvanized layer on the surface, and the symbol GA represents a steel sheet which was immersed in a hot-dip galvanizing bath, subsequently heated to 485° C., and thereby provided with an alloy layer of iron and zinc on the surface. In addition, on each of the steel sheets, a tempering treatment, in which the steel sheet once cooled to 150° C. was reheated and retained for 2 to 120 seconds in a period between retention of the steel sheet at the respective retention temperatures in cold-rolled sheet annealing and subsequent cooling of the steel sheet to room temperature, was performed. It is noted here that, in those Examples where the tempering time was in a range of 3,600 to 33,000 seconds, each steel sheet wound into a coil form after being cooled to room temperature was tempered using a separate annealing apparatus (box annealing furnace). Moreover, in those Examples with a description of "none" for tempering in Table 3, tempering was not performed. The thus obtained results are shown in Table 4. As for the methods of evaluating the properties, the same methods were employed as in Example 1.

TABLE 3-1

| | Slab | | | Retention time | | Cold-rolled sheet annealing | | | |
|---|---|---|---|---|---|---|---|---|---|
| No. | rolling reduction ratio (%) | Hot-rolling finishing temperature (° C.) | Coiling temperature (° C.) | at [coiling start temperature + 20° C. to 100° C.] (min) | Cold-rolling reduction ratio (%) | Heating rate (° C./sec) | Annealing temperature (° C.) | Retention time (sec) | Average cooling rate (° C./sec) |
| A-2 | 11 | 910 | 432 | 134 | 72.5 | 58.2 | 821 | 83 | 63.6 |
| B-2 | 18 | 796 | 484 | 204 | 26.5 | 41.2 | 757 | 547 | 10.1 |
| C-2 | 11 | 685 | 416 | 134 | 36.0 | 46.3 | 808 | 55 | 69.6 |
| D-2 | 21 | 726 | 677 | 174 | **93.2** | 21.1 | 746 | 564 | 62.4 |
| E-2 | 10 | 864 | 599 | 154 | **6.8** | 39.7 | 898 | 386 | 83.5 |
| F-2 | **46** | 877 | 680 | 41 | 76.8 | 72.4 | 853 | 307 | 97.7 |
| G-2 | 35 | 850 | 657 | 103 | 30.2 | 34.8 | 738 | 331 | 8.4 |
| H-2 | 15 | 740 | 508 | 103 | 86.8 | 85.2 | 800 | 385 | 41.9 |
| I-2 | 38 | 728 | 566 | 284 | 47.3 | 69.8 | 743 | 117 | 27.4 |
| J-2 | 36 | 686 | 549 | 169 | 62.4 | 25.2 | 728 | 118 | 11.7 |
| K-2 | 31 | 696 | 479 | 86 | 28.1 | 50.6 | 708 | 576 | 35.4 |
| L-2 | 21 | 851 | 677 | **3** | 31.9 | 54.7 | 802 | 173 | 22.1 |
| M-2 | 28 | 753 | 635 | 72 | 64.2 | 25.5 | 844 | 408 | 93.4 |
| N-2 | 32 | 933 | 494 | 68 | 89.1 | 82.9 | 820 | 528 | 76.0 |
| O-2 | 26 | 785 | 447 | 139 | 18.8 | 90.3 | 775 | 309 | 24.3 |
| P-2 | 20 | 827 | 634 | 220 | 23.4 | 5.7 | 724 | 434 | 63.8 |
| Q-2 | 16 | 767 | 590 | 276 | 42.6 | 97.0 | **919** | 66 | 79.8 |
| R-2 | 26 | **637** | 429 | 28 | 15.9 | 15.2 | 737 | 213 | 38.3 |
| A-3 | 9 | 897 | 618 | 252 | 23.1 | 30.1 | 763 | 141 | 82.6 |
| B-3 | 28 | 794 | 585 | 68 | 69.0 | 52.8 | 745 | 184 | 18.9 |
| C-3 | 13 | 696 | 611 | 182 | 28.5 | 15.7 | 846 | 267 | 8.9 |
| D-3 | 15 | 829 | 475 | 257 | 65.2 | 88.0 | 820 | 515 | 66.8 |
| E-3 | 7 | 817 | 597 | 70 | 88.2 | 11.2 | 828 | 126 | 80.1 |
| F-3 | 35 | 913 | 525 | 29 | 72.5 | 62.7 | 870 | 373 | 90.6 |
| G-3 | 28 | 667 | 658 | 119 | 81.3 | 61.0 | 716 | 422 | 46.3 |
| H-3 | 25 | 690 | 668 | 225 | 43.5 | 79.6 | 808 | 484 | 19.4 |
| I-3 | 37 | 745 | 554 | 245 | 47.1 | 59.8 | 807 | 445 | 46.9 |

| | Cold-rolled sheet annealing | | | | Cold-rolled sheet annealing | | Skin pass | |
|---|---|---|---|---|---|---|---|---|
| No. | Cooling stop temperature (° C.) | Retention temperature (° C.) | Retention time (sec) | Plating treatment | Tempering temperature (° C.) | Tempering time (sec) | rolling ratio (%) | Note |
| A-2 | 429 | 362 | 314 | none | 212 | 20 | 0.3 | Example |
| B-2 | 504 | 504 | 287 | GA | 334 | 19 | 0.5 | Example |
| C-2 | 514 | 399 | 65 | none | 343 | 47 | 0.3 | Example |
| D-2 | 484 | 426 | 146 | none | 180 | 24 | 0.3 | Comparative Example |
| E-2 | 316 | 535 | 450 | none | 325 | 34 | 0.3 | Comparative Example |
| F-2 | 286 | 378 | 437 | none | 350 | 13 | 0.5 | Comparative Example |
| G-2 | 187 | 382 | 61 | none | 208 | 3,600 | 0.6 | Example |
| H-2 | 164 | 448 | 217 | none | 223 | 35 | 0.4 | Example |
| I-2 | 386 | 511 | 238 | none | 315 | 62 | 0.2 | Example |
| J-2 | 530 | 529 | 372 | GA | 202 | 27 | 0.2 | Example |
| K-2 | 532 | 472 | 554 | none | 175 | 11 | 0.6 | Example |

TABLE 3-1-continued

| | | | | | | | | |
|---|---|---|---|---|---|---|---|---|
| L-2 | 132 | 386 | 195 | none | 214 | 43 | 0.4 | Comparative Example |
| M-2 | 312 | 467 | 206 | none | 311 | 27 | 0.1 | Example |
| N-2 | 531 | 528 | 117 | GA | 375 | 252 | 0.1 | Example |
| O-2 | 83 | 525 | 337 | none | 256 | 7 | 0.6 | Example |
| P-2 | 94 | 424 | 404 | none | 234 | 20 | 0.3 | Example |
| Q-2 | 191 | 413 | 320 | none | 196 | 55 | 0.2 | Comparative Example |
| R-2 | 285 | 492 | 512 | none | 162 | 3 | 0.2 | Comparative Example |
| A-3 | 235 | 419 | 359 | none | none | none | 0.4 | Example |
| B-3 | 284 | 436 | 396 | none | 232 | 12 | 0.1 | Example |
| C-3 | 406 | 537 | 100 | none | 186 | 24 | 0.1 | Example |
| D-3 | 512 | 512 | 332 | GI | 377 | 23 | 0.5 | Example |
| E-3 | 445 | 525 | 211 | none | 368 | 29 | 0.5 | Example |
| F-3 | 405 | 387 | 334 | none | 191 | 5 | 0.4 | Example |
| G-3 | 545 | 533 | 419 | GI | 263 | 119 | 0.3 | Example |
| H-3 | 237 | 355 | 137 | none | 272 | 33 | 0.5 | Example |
| I-3 | 521 | 501 | 263 | GA | 340 | 24 | 0.4 | Example |

*Bold and underlined values are outside the scope of the present invention.

TABLE 3-2

| | Slab | | | Retention time | | Cold-rolled sheet annealing | | | |
|---|---|---|---|---|---|---|---|---|---|
| No. | rolling reduction ratio (%) | Hot-rolling finishing temperature (° C.) | Coiling temperature (° C.) | at [coiling start temperature + 20° C. to 100° C.] (min) | Cold-rolling reduction ratio (%) | Heating rate (° C./sec) | Annealing temperature (° C.) | Retention time (sec) | Average cooling rate (° C./sec) |
| J-3 | 14 | 782 | 503 | 15 | 53.9 | 67.3 | 796 | 27 | 49.5 |
| K-3 | 11 | 673 | 426 | 217 | 71.0 | 87.1 | 721 | 341 | 53.1 |
| L-3 | 39 | 883 | 446 | 269 | 44.1 | 38.1 | 737 | 297 | 91.9 |
| M-3 | 25 | 826 | 405 | 204 | 85.5 | 25.8 | 866 | 464 | 74.2 |
| N-3 | 36 | 904 | 466 | 244 | 51.2 | 13.9 | 845 | 79 | 28.8 |
| O-3 | 31 | 713 | 503 | 174 | 20.6 | 6.1 | 835 | 254 | 68.4 |
| P-3 | 23 | **969** | 568 | 48 | 15.3 | 64.2 | 828 | 560 | 76.1 |
| Q-3 | 30 | 886 | 580 | 280 | 75.2 | 94.9 | 719 | 59 | 26.5 |
| R-3 | 19 | 754 | **733** | 187 | 58.5 | 65.5 | 877 | 505 | 76.5 |
| A-4 | 20 | 840 | 641 | 35 | 76.8 | 80.4 | 790 | 505 | 53.7 |
| B-4 | 6 | 794 | 673 | 185 | 37.7 | 19.0 | 777 | 246 | 35.1 |
| C-4 | 23 | 931 | 448 | **317** | 35.2 | 48.7 | 893 | 120 | 59.9 |
| D-4 | 29 | 782 | 524 | 223 | 21.0 | 76.1 | 760 | 338 | 8.4 |
| E-4 | 7 | 710 | **391** | 19 | 59.7 | 48.6 | 857 | 365 | 50.7 |
| F-4 | 12 | 716 | 565 | 84 | 41.0 | 6.7 | 776 | 226 | 47.2 |
| G-4 | 38 | 720 | 448 | 280 | 46.3 | 56.6 | 841 | 148 | 58.7 |
| H-4 | 17 | 865 | 552 | 115 | 38.3 | 8.5 | 819 | 37 | 69.3 |
| I-4 | 9 | 939 | 455 | 120 | 60.3 | 45.7 | **692** | 152 | 88.0 |
| J-4 | 21 | 766 | 644 | 152 | 35.2 | 29.9 | 882 | 334 | 54.9 |
| K-4 | 32 | 899 | 537 | 59 | 69.2 | 75.7 | 750 | 540 | 16.3 |
| L-4 | 18 | 814 | 630 | 113 | 54.3 | 9.1 | 756 | 484 | 30.5 |
| M-4 | 33 | 848 | 632 | 190 | 13.7 | 72.6 | 777 | 215 | 39.6 |
| N-4 | 14 | 931 | 615 | 52 | 18.9 | 40.3 | 791 | 252 | 24.0 |
| O-4 | **4** | 768 | 526 | 211 | 79.3 | 78.8 | 872 | 358 | 84.4 |
| P-4 | 23 | 713 | 513 | 264 | 60.4 | 36.2 | 783 | 437 | 15.7 |
| Q-4 | 8 | 878 | 465 | 84 | 54.5 | 22.7 | 722 | 290 | 37.6 |
| R-4 | 28 | 669 | 545 | 280 | 36.9 | 84.3 | 878 | 181 | 86.7 |

| | Cold-rolled sheet annealing | | | | Cold-rolled sheet annealing | | Skin pass | |
|---|---|---|---|---|---|---|---|---|
| No. | Cooling stop temperature (° C.) | Retention temperature (° C.) | Retention time (sec) | Plating treatment | Tempering temperature (° C.) | Tempering time (sec) | rolling ratio (%) | Note |
| J-3 | 352 | 518 | 59 | none | 341 | 36 | 0.3 | Example |
| K-3 | 210 | 368 | 123 | none | 278 | 33,000 | 0.4 | Example |
| L-3 | 362 | 425 | 288 | none | 209 | 14 | 0.4 | Example |
| M-3 | 500 | 358 | 152 | none | 336 | 11 | 0.6 | Example |
| N-3 | 547 | 547 | 403 | GA | 297 | 13 | 0.3 | Example |
| O-3 | 158 | 494 | 201 | none | 258 | 22 | 0.5 | Example |
| P-3 | 534 | 543 | 303 | none | 245 | 55 | 0.2 | Comparative Example |
| Q-3 | 47 | 440 | 446 | none | 356 | 28 | 0.4 | Example |
| R-3 | 233 | 528 | 30 | none | 266 | 15 | 0.4 | Comparative Example |
| A-4 | 509 | 496 | 399 | GI | none | none | 0.2 | Example |
| B-4 | 479 | 476 | 593 | none | 308 | 43 | 0.5 | Example |
| C-4 | 468 | 413 | 513 | none | 276 | 58 | 0.2 | Comparative Example |
| D-4 | 140 | 478 | 165 | none | 160 | 49 | 0.4 | Example |

TABLE 3-2-continued

| | | | | | | | | |
|---|---|---|---|---|---|---|---|---|
| E-4 | 205 | 490 | 531 | none | 246 | 6 | 0.3 | Comparative Example |
| F-4 | 400 | 450 | 163 | none | 347 | 381 | 0.3 | Example |
| G-4 | 126 | 445 | 490 | none | 303 | 55 | 0.3 | Example |
| H-4 | 170 | 399 | 453 | none | 388 | 19,000 | 0.2 | Example |
| I-4 | 487 | 437 | 235 | none | 367 | 31 | 0.5 | Comparative Example |
| J-4 | 149 | 499 | 247 | none | 293 | 10 | 0.2 | Example |
| K-4 | 315 | 373 | 556 | none | 302 | 23 | 0.3 | Example |
| L-4 | 398 | 399 | 484 | none | 287 | 17 | 0.5 | Example |
| M-4 | 512 | 492 | 532 | GA | 298 | 61 | 0.5 | Example |
| N-4 | 360 | 516 | 81 | none | 375 | 39 | 0.2 | Example |
| O-4 | 467 | 444 | 47 | none | 382 | 57 | 0.4 | Comparative Example |
| P-4 | 541 | 537 | 171 | GA | none | none | 0.2 | Example |
| Q-4 | 423 | 460 | 559 | none | 178 | 39 | 0.4 | Example |
| R-4 | 223 | 426 | 476 | none | 164 | 43 | 0.5 | Example |

*Bold and underlined values are outside the scope of the present invention.

TABLE 4-1

| No. | Total of ferrite and bainite (%) | Total of martensite and tempered martensite (%) | Total of pearlite and retained austenite (%) | Integration degree of (111)<112> orientation of ferrite | Integration degree of (252)<2-11> orientation of martensite and tempered martensite | Tensile strength (MPa) | Total elongation (%) | Stretch formability | Sheet thickness (mm) | Note |
|---|---|---|---|---|---|---|---|---|---|---|
| A-2 | 19.3 | 79.6 | 1.1 | 3.9 | 1.2 | 891 | 17.3 | ○ | 0.6 | Example |
| B-2 | 57.9 | 40.8 | 1.3 | 4.7 | 2.2 | 1,047 | 14.6 | ○ | 1.7 | Example |
| C-2 | 28.7 | 70.3 | 1.0 | 5.1 | 4.0 | 963 | 15.9 | ○ | 1.5 | Example |
| D-2 | 56.5 | 42.8 | 0.7 | 4.5 | **5.4** | 1,037 | 14.6 | x | 0.2 | Comparative Example |
| E-2 | 12.6 | 85.6 | 1.8 | **2.3** | 2.7 | 1,040 | 14.3 | x | 2.1 | Comparative Example |
| F-2 | 23.7 | 75.2 | 1.1 | **2.8** | 1.3 | 891 | 17.3 | x | 0.5 | Comparative Example |
| G-2 | 65.4 | 31.3 | 3.3 | 4.0 | 1.8 | 777 | 20.2 | ○ | 1.6 | Example |
| H-2 | 31.7 | 67.3 | 1.0 | 3.8 | 3.3 | 984 | 15.5 | ○ | 0.3 | Example |
| I-2 | 69.3 | 29.1 | 1.6 | 4.4 | 4.7 | 927 | 16.5 | ○ | 1.2 | Example |
| J-2 | 59.4 | 39.2 | 1.4 | 5.1 | 1.6 | 1,036 | 14.8 | ○ | 0.9 | Example |
| K-2 | 77.2 | 21.8 | 1.0 | 3.9 | 1.2 | 808 | 19.2 | ○ | 1.7 | Example |
| L-2 | 26.3 | 73.3 | 0.4 | 6.1 | **5.8** | 1,058 | 14.1 | x | 1.6 | Comparative Example |
| M-2 | 58.3 | 40.7 | 1.0 | 6.0 | 0.6 | 981 | 15.7 | ○ | 0.8 | Example |
| N-2 | 49.1 | 49.8 | 1.1 | 3.4 | 0.4 | 840 | 18.1 | ○ | 0.3 | Example |
| O-2 | 73.8 | 25.0 | 1.2 | 3.8 | 4.2 | 1,044 | 14.4 | ○ | 1.9 | Example |
| P-2 | 87.3 | 11.7 | 1.0 | 3.2 | 4.9 | 1,036 | 14.5 | ○ | 1.8 | Example |
| Q-2 | 11.9 | 78.3 | 9.8 | **2.4** | 1.6 | 984 | 15.3 | x | 1.3 | Comparative Example |
| R-2 | 71.1 | 27.9 | 1.0 | **1.1** | **6.8** | 1,001 | 14.9 | x | 1.9 | Comparative Example |
| A-3 | 47.4 | 51.4 | 1.2 | 4.5 | 1.9 | 992 | 15.4 | ○ | 1.8 | Example |
| B-3 | 64.4 | 34.5 | 1.1 | 5.0 | 1.0 | 1,052 | 14.3 | ○ | 0.7 | Example |
| C-3 | 19.0 | 78.9 | 2.1 | 3.3 | 1.9 | 882 | 17.3 | ○ | 1.6 | Example |
| D-3 | 13.9 | 79.8 | 6.3 | 4.0 | 1.6 | 930 | 16.4 | ○ | 0.8 | Example |
| E-3 | 32.7 | 65.6 | 1.7 | 3.6 | 3.9 | 1,100 | 13.4 | ○ | 0.3 | Example |
| F-3 | 23.6 | 75.2 | 1.2 | 5.3 | 3.0 | 891 | 16.9 | ○ | 0.6 | Example |
| G-3 | 73.6 | 25.0 | 1.4 | 4.3 | 4.7 | 814 | 19.1 | ○ | 0.4 | Example |
| H-3 | 30.1 | 68.9 | 1.0 | 4.5 | 2.1 | 971 | 15.8 | ○ | 1.3 | Example |
| I-3 | 36.5 | 62.4 | 1.1 | 5.2 | 2.1 | 974 | 15.8 | ○ | 1.2 | Example |

*Bold and underlined values are outside the scope of the present invention.

TABLE 4-2

| No. | Total of ferrite and bainite (%) | Total of martensite and tempered martensite (%) | Total of pearlite and retained austenite (%) | Integration degree of (111)<112> orientation of ferrite | Integration degree of (252)<2-11> orientation of martensite and tempered martensite | Tensile strength (MPa) | Total elongation (%) | Stretch formability | Sheet thickness (mm) | Note |
|---|---|---|---|---|---|---|---|---|---|---|
| J-3 | 15.3 | 79.6 | 5.1 | 5.4 | 3.0 | 902 | 16.6 | ○ | 1.1 | Example |
| K-3 | 83.9 | 12.7 | 3.4 | 5.0 | 4.5 | 761 | 20.3 | ○ | 0.7 | Example |
| L-3 | 60.8 | 38.2 | 1.0 | 4.2 | 1.3 | 1,031 | 14.8 | ○ | 1.3 | Example |
| M-3 | 52.4 | 46.6 | 1.0 | 5.4 | 1.6 | 991 | 15.2 | ○ | 0.3 | Example |
| N-3 | 47.9 | 48.7 | 3.4 | 5.9 | 3.2 | 760 | 20.4 | ○ | 1.1 | Example |
| O-3 | 44.7 | 54.3 | 1.0 | 4.5 | 0.9 | 1,064 | 14 | ○ | 1.8 | Example |
| P-3 | 58.1 | 40.9 | 1.0 | **1.5** | **6.1** | 1,060 | 14.3 | x | 1.9 | Comparative Example |
| Q-3 | 89.1 | 9.2 | 1.7 | 4.5 | 1.5 | 945 | 15.8 | ○ | 0.6 | Example |
| R-3 | 13.8 | 78.9 | 7.3 | 5.5 | **7.5** | 923 | 16.5 | x | 1 | Comparative Example |
| A-4 | 34.5 | 64.5 | 1.0 | 4.7 | 3.8 | 984 | 15.3 | ○ | 0.5 | Example |
| B-4 | 45.5 | 53.5 | 1.0 | 5.7 | 4.6 | 1,024 | 15 | ○ | 1.4 | Example |
| C-4 | — | — | — | — | — | — | — | — | — | — |
| D-4 | 55.3 | 43.6 | 1.1 | 4.3 | 2.1 | 1,036 | 14.5 | ○ | 1.8 | Example |
| E-4 | 26.3 | 72.6 | 1.1 | 3.2 | **6.7** | 1,085 | 13.9 | x | 0.9 | Comparative Example |
| F-4 | 61.3 | 37.5 | 1.2 | 6.1 | 3.9 | 827 | 18.7 | ○ | 1.4 | Example |
| G-4 | 16.7 | 78.7 | 4.6 | 3.5 | 0.4 | 924 | 16.2 | ○ | 1.2 | Example |
| H-4 | 19.6 | 79.4 | 1.0 | 5.9 | 1.0 | 860 | 18 | ○ | 1.4 | Example |
| I-4 | 88.6 | **0.3** | 11.1 | 6.1 | 3.8 | **468** | 24.5 | x | 0.9 | Comparative Example |
| J-4 | 16.4 | 79.2 | 4.4 | 4.4 | 1.1 | 911 | 16.9 | ○ | 1.5 | Example |
| K-4 | 77.6 | 21.4 | 1.0 | 6.1 | 1.3 | 833 | 18.6 | ○ | 0.7 | Example |
| L-4 | 50.5 | 48.4 | 1.1 | 3.8 | 2.5 | 1,018 | 14.6 | ○ | 1.1 | Example |
| M-4 | 81.4 | 17.6 | 1.0 | 3.3 | 0.8 | 928 | 16.2 | ○ | 2 | Example |
| N-4 | 64.5 | 34.4 | 1.1 | 4.9 | 2.5 | 717 | 22 | ○ | 1.9 | Example |
| O-4 | 27.0 | 72.0 | 1.0 | **2.2** | **5.9** | 988 | 15.3 | x | 0.5 | Comparative Example |
| P-4 | 74.1 | 24.9 | 1.0 | 5.1 | 4.3 | 1,033 | 14.6 | ○ | 0.9 | Example |
| Q-4 | 89.4 | 9.2 | 1.4 | 4.8 | 0.4 | 948 | 15.8 | ○ | 1 | Example |
| R-4 | 14.4 | 79.8 | 5.8 | 3.9 | 1.5 | 911 | 16.5 | ○ | 1.5 | Example |

*Bold and underlined values are outside the scope of the present invention.

Referring to Table 4, in Example D-2, the integration degree of the (252)<2-11> orientation of martensite and tempered martensite was high due to the high rolling reduction ratio in the cold rolling, as a result of which the stretch formability was deteriorated. In Example E-2, the integration degree of the (111)<112> orientation was low due to the low rolling reduction ratio in the cold rolling, as a result of which the stretch formability was deteriorated. In Example F-2, since the rolling reduction ratio in the casting step was excessively high, the integration degree of the (111)<112> orientation of ferrite after the cold-rolled sheet annealing was low, and the stretch formability was consequently deteriorated. In Example L-2, since the post-coiling retention time at the prescribed temperature was short, the integration degree of the (252)<2-11> orientation of martensite and tempered martensite was not reduced, as a result of which the stretch formability was deteriorated.

In Example Q-2, since the annealing temperature was high, the integration degree of the (111)<112> orientation of ferrite was low, as a result of which the stretch formability was deteriorated. In Example R-2, since the hot-rolling finishing temperature was low, a rolled crystallographic texture of austenite developed, and this caused anisotropy in the steel material properties, as a result of which the integration degree of the (252)<2-11> orientation of martensite in the final product was not reduced, and the stretch formability was deteriorated. In Example P-3, since the hot-rolling finishing temperature was high, abnormal growth of austenite grains occurred and the crystallographic texture could not be made isotropic, as a result of which the integration degree of the (111)<112> orientation of ferrite was reduced, and the stretch formability was deteriorated. In Example R-3, due to the high coiling temperature, pearlite transformation was allowed to progress in the post-coiling heating treatment, and the target hot-rolled structure was thus not obtained, as a result of which the integration degree of the (252)<2-11> orientation of martensite in the final product was high, and the stretch formability was deteriorated.

In Example C-4, since the post-coiling retention time at the prescribed temperature was long, internal oxides were formed in the hot-rolled sheet, and cracks were generated on the steel sheet surface in the subsequent treatments. Therefore, the analysis of the structure and the evaluation of the mechanical properties were not performed. In Example E-4, due to the low coiling temperature, the target hot-rolled structure was not obtained even with a post-coiling heating treatment, as a result of which the integration degree of the (252)<2-11> orientation of martensite in the final product was high, and the stretch formability was deteriorated. In Example I-4, due to the low annealing temperature, not only the amount of generated austenite was small and the ratio of martensite structure was reduced in the structure after the cold rolling and annealing, but also non-recrystallized ferrite remained, as a result of which the tensile strength and the stretch formability were both deteriorated. In Example O-4, due to the low rolling reduction ratio in the casting step, the integration degree of the (111)<112> orientation of ferrite was low and the integration degree of the (252)<2-11> orientation of martensite and tempered martensite was high, as a result of which the stretch formability was deteriorated.

In contrast to the above, in all of Examples according to the present invention, a steel sheet having a high strength and excellent stretch formability was obtained particularly by performing rolling reduction at a prescribed reduction ratio in the casting step, and additionally controlling the hot-rolling finishing temperature, the coiling, the cold rolling, and the annealing as appropriate.

FIG. 1 is a graph showing the effects of the integration degree of the (111)<112> orientation of ferrite and the integration degree of the (252)<2-11> orientation of martensite and tempered martensite on the stretch formability of the DP steels used in Examples 1 and 2. As apparent from FIG. 1, it is understood that a steel sheet having excellent stretch formability can be obtained by controlling the integration degree of the (111)<112> orientation of ferrite to be 3.0 or higher, and the integration degree of the (252)<2-11> orientation of martensite and tempered martensite to be 5.0 or lower.

The invention claimed is:

1. A steel sheet, having a chemical composition comprising, by mass %:

C: 0.05 to 0.20%;
Si: 0.01 to 1.30%;
Mn: 1.00 to 3.00%;
P: 0.0001 to 0.0200%;
S: 0.0001 to 0.0200%;
Al: 0.001 to 1.000%;
N: 0.0001 to 0.0200%;
Co: 0 to 0.5000%;
Ni: 0 to 0.5000%;
Mo: 0 to 0.5000%;
Cr: 0 to 1.0000%;
O: 0 to 0.0200%;
Ti: 0 to 0.5000%;
B: 0 to 0.0100%;
Nb: 0 to 0.5000%;
V: 0 to 0.5000%;
Cu: 0 to 0.5000%;
W: 0 to 0.1000%;
Ta: 0 to 0.1000%;
Sn: 0 to 0.0500%;
Sb: 0 to 0.0500%;
As: 0 to 0.0500%;
Mg: 0 to 0.0500%;
Ca: 0 to 0.0500%;
Y: 0 to 0.0500%;
Zr: 0 to 0.0500%;
La: 0 to 0.0500%;
Ce: 0 to 0.0500%; and
the balance of Fe and impurities,
wherein
the steel sheet comprises, by area ratio:
a total of ferrite and bainite: 10.0 to 90.0%;
a total of martensite and tempered martensite: 5.0 to 80.0%; and
a total of pearlite and retained austenite: 0 to 15.0%,
integration degree of (111)<112> orientation of ferrite is 3.0 or higher, and
integration degree of (252)<2-11> orientation of martensite and tempered martensite is 5.0 or lower.

2. The steel sheet according to claim 1, comprising one or more of:

Co: 0.0001 to 0.5000%;
Ni: 0.0001 to 0.5000%;
Mo: 0.0001 to 0.5000%;
Cr: 0.0001 to 1.0000%;
O: 0.0001 to 0.0200%;
Ti: 0.0001 to 0.5000%;
B: 0.0001 to 0.0100%;
Nb: 0.0001 to 0.5000%;
V: 0.0001 to 0.5000%;
Cu: 0.0001 to 0.5000%;
W: 0.0001 to 0.1000%;
Ta: 0.0001 to 0.1000%;
Sn: 0.0001 to 0.0500%;
Sb: 0.0001 to 0.0500%;
As: 0.0001 to 0.0500%;
Mg: 0.0001 to 0.0500%;
Ca: 0.0001 to 0.0500%;
Y: 0.0001 to 0.0500%;
Zr: 0.0001 to 0.0500%;
La: 0.0001 to 0.0500%; and
Ce: 0.0001 to 0.0500%.

3. A method of producing the steel sheet of claim 1, the method comprising:

a casting step of continuously casting a molten steel having the chemical composition according to claim 1 to form a slab, wherein 5 to 40% rolling reduction is performed at a temperature of 800° C. to lower than 1,200° C. in a period after the continuous casting and before cooling to room temperature;
a hot rolling step which includes hot rolling the slab and in which a finishing temperature of the hot rolling is 650 to 950° C.;
a step of coiling the thus obtained hot-rolled steel sheet at a coiling temperature of 400 to 700° C.;
a step of retaining the thus coiled hot-rolled steel sheet as is wherein the thus coiled hot-rolled steel sheet is not cooled to room temperature before retaining and is retained in a temperature range of (coiling start temperature+20° C. to 100° C.) for 5 to 300 minutes;
a cold rolling step of cold rolling the hot-rolled steel sheet at a rolling reduction ratio of 10.0 to 90.0%; and
an annealing step of annealing the thus obtained cold-rolled steel sheet in a temperature range of 700 to 900° C.

4. A method of producing the steel sheet of claim 2, the method comprising:

a casting step of continuously casting a molten steel having the chemical composition according to claim 2 to form a slab, wherein 5 to 40% rolling reduction is performed at a temperature of 800° C. to lower than 1,200° C. in a period after the continuous casting and before cooling to room temperature;
a hot rolling step which includes hot rolling the slab and in which a finishing temperature of the hot rolling is 650 to 950° C.;
a step of coiling the thus obtained hot-rolled steel sheet at a coiling temperature of 400 to 700° C.;
a step of retaining the thus coiled hot-rolled steel sheet as is wherein the thus coiled hot-rolled steel sheet is not cooled to room temperature before retaining and is retained in a temperature range of (coiling start temperature+20° C. to 100° C.) for 5 to 300 minutes;
a cold rolling step of cold rolling the hot-rolled steel sheet at a rolling reduction ratio of 10.0 to 90.0%; and
an annealing step of annealing the thus obtained cold-rolled steel sheet in a temperature range of 700 to 900° C.

* * * * *